US006703789B2

(12) United States Patent
Hiraga

(10) Patent No.: US 6,703,789 B2
(45) Date of Patent: Mar. 9, 2004

(54) MULTIPLEX ANODE DRIVER CIRCUIT AND FLORESCENT DISPLAY DEVICE

(75) Inventor: Minoru Hiraga, Mobara (JP)

(73) Assignee: Eutaba Corporation, Mobara (JP)

( * ) Notice: Subject to any disclaimer, the term of this patent is extended or adjusted under 35 U.S.C. 154(b) by 0 days.

(21) Appl. No.: 10/358,161

(22) Filed: Feb. 5, 2003

(65) Prior Publication Data

US 2003/0146708 A1 Aug. 7, 2003

(30) Foreign Application Priority Data

Feb. 6, 2002 (JP) ..... 2002-029705

(51) Int. Cl.[7] ..... G09G 3/10
(52) U.S. Cl. ..... 315/169.2; 345/75.1; 345/55
(58) Field of Search ..... 315/169.1–169.4; 345/75, 75.1, 77, 55, 61, 213, 559, 552–556

(56) References Cited

U.S. PATENT DOCUMENTS 5,155,413 A * 10/1992 Bozzer et al. ..... 315/169.1
5,298,920 A * 3/1994 Shindo ..... 345/75.1
6,583,576 B2 * 6/2003 Koyama ..... 315/169.2
2003/0001800 A1 * 1/2003 Nakajima et al. ..... 345/55

* cited by examiner

*Primary Examiner*—Wilson Lee
(74) *Attorney, Agent, or Firm*—Oblon, Spivak, McClelland, Maier & Neustadt, P.C.

(57) ABSTRACT

A multiplex anode driver circuit is provided that enables a reduced RAM capacity, an improved speed, and slimmed hardware. The multiplex anode driver circuit outputs anode data in sync with the timing when two adjacent grids are sequentially scanned in the direction of a row of anodes. The anode driver circuit has the shift register allocated with an even-numbered grid timing and the shift register allocated with an odd-numbered grid timing, in a two system. In the shift register, the registers are connected to the latch circuits, which hold anode data of the registers. In the shift register, the registers are connected to the latch circuits which hold anode data of the registers. The blanking input to the latch circuit associated with the shift register and the blanking input to the latch circuit associated with the shift register are released alternatively while the even-numbered grid timing and the odd-numbered grid timing are selected. Thus, anode data is transferred to the memory.

4 Claims, 25 Drawing Sheets

FIG.10

| SWITCH (SW) SELECT | DRIVING SCHEME | SWITCH (SW) NUMBER | | | | | | | | | | | | | | | | |
|---|---|---|---|---|---|---|---|---|---|---|---|---|---|---|---|---|---|---|
| | | SW1 | | SW2 | | SW3 | | SW4 | | SW5 | | SW6 | | SW7 | | SW8 | | .... |
| | | SIa | SIb | SIa | SIb | SIa | SIb | SIa | SIb | SIa | SIb | SIa | SIb | SIa | SIb | SIa | SIb | .... |
| M1 | SINGLE ANODE MATRIX SCHEME | ○ | × | ○ | × | ○ | × | ○ | × | ○ | × | ○ | × | ○ | × | ○ | × | .... |
| M2 | DUPLEX ANODE MATRIX SCHEME | ○ | × | × | ○ | ○ | × | × | ○ | ○ | × | × | ○ | ○ | × | × | ○ | .... |
| M4 | QUADPLEX ANODE MATRIX SCHEME | ○ | × | ○ | × | × | ○ | × | ○ | ○ | × | ○ | × | × | ○ | × | ○ | .... |
| M8 | OCTUPLEX ANODE MATRIX SCHEME | ○ | × | ○ | × | ○ | × | ○ | × | × | ○ | × | ○ | × | ○ | × | ○ | .... |

FIG.11

| SWITCH (SW) SELECT | DRIVING SCHEME | SWITCH (SW) NUMBER | | | | | | | | | | | | | | | | |
|---|---|---|---|---|---|---|---|---|---|---|---|---|---|---|---|---|---|---|
| | | SW 1 | SW 2 | SW 3 | SW 4 | SW 5 | SW 6 | SW 7 | SW 8 | SW 9 | SW 10 | SW 11 | SW 12 | SW 13 | SW 14 | SW 15 | SW 16 | .... |
| | | Sla | Sla | Sla | Sla | Sla | Sla | Sla | Sla | Sla | Sla | Sla | Sla | Sla | Sla | Sla | Sla | .... |
| M1 | SINGLE ANODE MATRIX SCHEME | ○ | ○ | ○ | ○ | ○ | ○ | ○ | ○ | ○ | ○ | ○ | ○ | ○ | ○ | ○ | ○ | .... |
| M2 | DUPLEX ANODE MATRIX SCHEME | ○ | × | ○ | × | ○ | × | ○ | × | ○ | × | ○ | × | ○ | × | ○ | × | .... |
| M4 | QUADPLEX ANODE MATRIX SCHEME | ○ | ○ | × | × | ○ | ○ | × | × | ○ | ○ | × | × | ○ | ○ | × | × | .... |
| M8 | OCTUPLEX ANODE MATRIX SCHEME | ○ | ○ | ○ | ○ | × | × | × | × | ○ | ○ | ○ | ○ | × | × | × | × | .... |

FIG.13

| SWITCH (SW) SELECT | DRIVING SCHEME | SWITCH (SW) NUMBER | | | | | | | | | | | | | | | | |
|---|---|---|---|---|---|---|---|---|---|---|---|---|---|---|---|---|---|---|
| | | SW1 | | SW2 | | SW3 | | SW4 | | SW5 | | SW6 | | SW7 | | SW8 | | ···· |
| | | BK1 | BK2 | BK1 | BK2 | BK1 | BK2 | BK1 | BK2 | BK1 | BK2 | BK1 | BK2 | BK1 | BK2 | BK1 | BK2 | ···· |
| M1 | SINGLE ANODE MATRIX SCHEME | ○ | × | ○ | × | ○ | × | ○ | × | ○ | × | ○ | × | ○ | × | ○ | × | ···· |
| M2 | DUPLEX ANODE MATRIX SCHEME | ○ | × | × | ○ | ○ | × | × | ○ | ○ | × | × | ○ | ○ | × | × | ○ | ···· |
| M4 | QUADPLEX ANODE MATRIX SCHEME | ○ | × | ○ | × | × | ○ | × | ○ | ○ | × | ○ | × | × | ○ | × | ○ | ···· |
| M8 | OCTUPLEX ANODE MATRIX SCHEME | ○ | × | ○ | × | ○ | × | ○ | × | × | ○ | × | ○ | × | ○ | × | ○ | ···· |

FIG.14

| SWITCH (SW) SELECT | DRIVING SCHEME | SWITCH (SW) NUMBER | | | | | | | | | | | | | | | | |
|---|---|---|---|---|---|---|---|---|---|---|---|---|---|---|---|---|---|---|
| | | SW 1 | SW 2 | SW 3 | SW 4 | SW 5 | SW 6 | SW 7 | SW 8 | SW 9 | SW 10 | SW 11 | SW 12 | SW 13 | SW 14 | SW 15 | SW 16 | .... |
| | | BK1 | BK1 | BK1 | BK1 | BK1 | BK1 | BK1 | BK1 | BK1 | BK1 | BK1 | BK1 | BK1 | BK1 | BK1 | BK1 | .... |
| M1 | SINGLE ANODE MATRIX SCHEME | ○ | ○ | ○ | ○ | ○ | ○ | ○ | ○ | ○ | ○ | ○ | ○ | ○ | ○ | ○ | ○ | .... |
| M2 | DUPLEX ANODE MATRIX SCHEME | ○ | × | ○ | × | ○ | × | ○ | × | ○ | × | ○ | × | ○ | × | ○ | × | .... |
| M4 | QUADPLEX ANODE MATRIX SCHEME | ○ | ○ | × | × | ○ | ○ | × | × | ○ | ○ | × | × | ○ | ○ | × | × | .... |
| M8 | OCTUPLEX ANODE MATRIX SCHEME | ○ | ○ | ○ | ○ | × | × | × | × | ○ | ○ | ○ | ○ | × | × | × | × | .... |

FIG.19

| GRID SCAN TIMING | GRID SELECT | ON/OFF TIMING OF GRID | | | | | | | | |
|---|---|---|---|---|---|---|---|---|---|---|
| | | 1G | 2G | 3G | 4G | 5G | ··· | (n-2) G | (n-1) G | nG |
| T1 | 1G&2G | H | H | L | L | L | ··· | L | L | L |
| T2 | 2G&3G | L | H | H | L | L | ··· | L | L | L |
| T3 | 3G&4G | L | L | H | H | L | ··· | L | L | L |
| T4 | 4G&5G | L | L | L | H | H | ··· | L | L | L |
| : | : | : | : | : | : | : | : | : | : | : |
| Tn-2 | 38G&39G | L | L | L | L | L | ··· | H | H | L |
| Tn-1 | 39G&40G | L | L | L | L | L | ··· | L | H | H |
| Tn | 40G&1G | H | L | L | L | L | ··· | L | L | H |

FIG.20

| GRID TIMING | GRID SELECT | ANODE TERMINAL (TERMINAL) | | | | | | | | | | | | | NUMBER OF TRANSFER BITS OF ANODE DATA |
|---|---|---|---|---|---|---|---|---|---|---|---|---|---|---|---|
| | | 1-2 | 1-3 | 1-1 | 1-4 | 2-2 | 2-3 | 2-1 | 2-4 | ··· | n-2 | n-3 | n-1 | n-4 | |
| T1 | 1G&2G | ○ | ○ | × | × | ○ | ○ | × | × | ··· | ○ | ○ | × | × | n×4 |
| T2 | 2G&3G | × | × | ○ | ○ | × | × | ○ | ○ | ··· | × | × | ○ | ○ | n×4 |
| T3 | 3G&4G | ○ | ○ | × | × | ○ | ○ | × | × | ··· | ○ | ○ | × | × | n×4 |
| T4 | 4G&5G | × | × | ○ | ○ | × | × | ○ | ○ | ··· | × | × | ○ | ○ | n×4 |
| : | : | : | : | : | : | : | : | : | : | : | : | : | : | : | n×4 |
| Tn-2 | 38G&39G | × | × | ○ | ○ | × | × | ○ | ○ | ··· | × | × | ○ | ○ | n×4 |
| Tn-1 | 39G&40G | ○ | ○ | × | × | ○ | ○ | × | × | ··· | ○ | ○ | × | × | n×4 |
| Tn | nG&1G | × | × | ○ | ○ | × | × | ○ | ○ | ··· | × | × | ○ | ○ | n×4 |

FIG.24

| FUNCTION | SYMBOL | INPUT/ OUTPUT | CONTENT |
|---|---|---|---|
| SHIFT REGISTER CLOCK | CLK | INPUT | ↑ : DATA SHIFT |
| SERIAL DATA INPUT | SI | INPUT | REFER TO TIMING CHART |
| LATCH CONTROL INPUT | LAT | INPUT | H: DATA THROUGH<br>L: DATA LATCH |
| DRIVER OUTPUT BLANKING | BK | INPUT | L: OUTPUT ON<br>H OR OPEN: OUTPUT OFF |
| SERIAL DATA OUTPUT | SO | OUTPUT | OPEN IN UNUSED STATE |
| LOGIC POWER-SOURCE TERMINAL | VDD | INPUT | POWER-SOURCE TERMINAL FOR LOGIC CIRCUITS |
| GRID DRIVER POWER-SOURCE TERMINAL | VHG | INPUT | POWER-SOURCE TERMINAL FOR GRID DRIVER |
| ANODE DRIVER POWER-SOURCE TERMINAL | VHA | INPUT | POWER-SOURCE TERMINAL FOR ANODE DRIVER |
| GND TERMINAL | GND | INPUT | COMMON GND FOR VH AND VDD |
| FILAMENT TERMINAL | F1, F2 | INPUT | FILAMENT VOLTAGE INPUT TERMINAL |
| TEST PIN | TS | - | PIN NECESSARY FOR FABRICATION<br>OPEN |
| NO-CONNECTION | NC | - | PIN FOR NO CONNECTION |
| NO PIN | NP | - | NO PIN AT NP |

FIG.25

| | | | | | | | | | | | | | | | |
|---|---|---|---|---|---|---|---|---|---|---|---|---|---|---|---|
| R1 | R2 | R3 | R4 | R5 | R6 | R7 | R8 | R9 | R10 | R11 | R12 | R13 | R14 | R15 | R16 |
| 1-2 | 1-3 | 1-1 | 1-4 | 2-2 | 2-3 | 2-1 | 2-4 | 3-2 | 3-3 | 3-1 | 3-4 | 4-2 | 4-3 | 4-1 | 4-4 |
| R17 | R18 | R19 | R20 | R21 | R22 | R23 | R24 | R25 | R26 | R27 | R28 | R29 | R30 | R31 | R32 |
| 5-2 | 5-3 | 5-1 | 5-4 | 6-2 | 6-3 | 6-1 | 6-4 | 7-2 | 7-3 | 7-1 | 7-4 | 8-2 | 8-3 | 8-1 | 8-4 |
| R33 | R34 | R35 | R36 | R37 | R38 | R39 | R40 | R41 | R42 | R43 | R44 | R45 | R46 | R47 | R48 |
| 9-2 | 9-3 | 9-1 | 9-4 | 10-2 | 10-3 | 10-1 | 10-4 | 11-2 | 11-3 | 11-1 | 11-4 | 12-2 | 12-3 | 12-1 | 12-4 |
| R49 | R50 | R51 | R52 | R53 | R54 | R55 | R56 | R57 | R58 | R59 | R60 | R61 | R62 | R63 | R64 |
| 13-2 | 13-3 | 13-1 | 13-4 | 14-2 | 14-3 | 14-1 | 14-4 | 15-2 | 15-3 | 15-1 | 15-4 | 16-2 | 16-3 | 16-1 | 16-4 |
| R65 | R66 | R67 | R68 | R69 | R70 | R71 | R72 | R73 | R74 | R75 | R76 | R77 | R78 | R79 | R80 |
| 17-2 | 17-3 | 17-1 | 17-4 | 18-2 | 18-3 | 18-1 | 18-4 | 19-2 | 19-3 | 19-1 | 19-4 | 20-2 | 20-3 | 20-1 | 20-4 |
| R81 | R82 | R83 | R84 | R85 | R86 | R87 | R88 | R89 | R90 | R91 | R92 | R93 | R94 | R95 | R96 |
| 21-2 | 21-3 | 21-1 | 21-4 | 22-2 | 22-3 | 22-1 | 22-4 | 23-2 | 23-3 | 23-1 | 23-4 | 24-2 | 24-3 | 24-1 | 24-4 |
| R97 | R98 | R99 | R100 | R101 | R102 | R103 | R104 | R105 | R106 | R107 | R108 | R109 | R110 | R111 | R112 |
| 25-2 | 25-3 | 25-1 | 25-4 | 26-2 | 26-3 | 26-1 | 26-4 | 27-2 | 27-3 | 27-1 | 27-4 | 28-2 | 28-3 | 28-1 | 28-4 |
| R113 | R114 | R115 | R116 | R117 | R118 | R119 | R120 | R121 | R122 | R123 | R124 | R125 | R126 | R127 | R128 |
| 29-2 | 29-3 | 29-1 | 29-4 | 30-2 | 30-3 | 30-1 | 30-4 | 31-2 | 31-3 | 31-1 | 31-4 | 32-2 | 32-3 | 32-1 | 32-4 |

| | IN | | | | | | | OUT |
|---|---|---|---|---|---|---|---|---|
| SIA → | R1 | R2 | R3 | R4 | · · · | R126 | R127 | R128 |

NC, DON'T CARE EITHER "H" OR "L".

MULTIPLEX ANODE DRIVER CIRCUIT AND FLORESCENT DISPLAY DEVICE

BACKGROUND OF THE INVENTION

The present invention relates to a multiplex anode driver circuit for chiefly driving a graphic fluorescent display device employing a multiplex (duplex, quadplex, or octuplex) anode matrix scheme and to a fluorescent display device using the same. The present invention can be used for driving conventional consumer, industrial, or in-vehicle fluorescent display devices. That is, the present invention can be used for fluorescent display devices in a simple anode matrix scheme, in addition to fluorescent display devices in a multiplex anode matrix scheme. The present invention is applicable in all time-proven fields of fluorescent display devices.

Fluorescent display devices in an anode multi-matrix scheme are well known as fluorescent display devices that can provide light emission with high intensity, with uniform brightness, and with less variation in brightness.

A fluorescent display device employing a quadplex anode matrix scheme as an anode multi-matrix scheme will be now explained as an example. In a fluorescent display device of this type, dot-like anodes are arranged in a matrix form which includes plural rows each formed of plural dot-like anodes. A fluorescent substance is coated on the surface of each anode. Four anode connection terminals are disposed to each row.

In each row, the anodes appearing every four places are connected to the common anode connection terminal. A grid is disposed above the anodes appearing every two columns so as to confront each other. A cathode, e.g. a filament cathode, which emits electrons, is suspended above each grid so as to confront each other.

FIG. 15 is a diagram illustrating the connection configuration of anodes in a fluorescent display device employing the quadplex anode matrix scheme. FIG. 16 is shows a wiring diagram of the connection configuration shown in FIG. 15. In the anode connection configuration of FIGS. 15 and 16, one row of anodes is schematically shown.

Referring to FIG. 15, the anode A2 in the second column is connected to the anode A2*a*. The anode A3 in the third column is connected to the anode A3*a*. The anodes A2 and A2*a* are light emitted simultaneously by a positive voltage applied to the anode connection terminal AT1-2. The anodes A3 and A3*a* are light emitted simultaneously by a positive voltage applied to the anode connection terminal AT1-3. At this time, other anodes do not glow because a negative voltage is applied to the anode connection terminals connected to them.

Moreover, the anode A1 in the first column is connected to the anode A1*a*. The anode A4 in the fourth column is connected to the anode A4*a*. The anodes A1 and A1*a* are light-emitted simultaneously by a positive voltage applied to the anode connection terminal AT1-1. The anodes A4 and A4*a* are light emitted simultaneously by a positive voltage applied to the anode connection terminal AT1-4. At this time, other anodes do not glow because a negative voltage is applied to the anode connection terminal connected to them.

In the above-mentioned configuration, the wiring pattern for the anode connection terminal AT1-1 is disposed between the wiring pattern for the anode connection terminal AT1-2 and the wiring pattern for the anode connection terminal AT1-3. When a positive voltage is applied to the anode connection terminals AT1-2 and AT1-3, the anodes A1 and A1*a* associated with the anode connection terminal AT1-1 are in a non-glow state.

The wiring pattern for the anode connection terminal AT1-3 is disposed between the wiring pattern for the anode connection terminal AT1-1 and the wiring pattern for the anode connection terminal AT1-4. When a positive voltage is applied to the anode connection terminals AT1-1 and AT1-4, the anodes A3 and A3*a* associated with the anode connection terminal AT1-3 is in a non-glow state.

In the connection configuration shown in FIG. 15, the wiring pattern for the anode connection terminal (AT1-2, AT1-3 shown in FIG. 15), to which anodes (A2, A2*a*, A3, A3*a* in FIG. 15) in a non-glow state are connected, is disposed between the wiring pattern for anode connection terminal (AT1-1 in FIG. 15), to which anodes (A1 and A1*a* in FIG. 15) in a glow state are connected, and the wiring pattern for anode connection terminal (AT1-4 in FIG. 15), to which anodes (A4 and A4*a* in FIG. 15) in a glow state are connected. That is, the wiring pattern for anode connection terminal to which a positive voltage is applied and the wiring pattern to which a negative voltage is applied are disposed alternately.

In the fluorescent display device employing the quadplex anode matrix scheme, each grid is wired so as to cover two columns of anodes. Grids are scanned such that a positive voltage is always applied to two adjacent grids. A positive voltage is applied to the two middle anodes among the four anodes, corresponding to two grids to which the positive voltage is applied. The negative voltage is applied to the remaining anodes. By doing so, the anode dot at a desired position in a desired row of anodes is selectively light emitted.

In the fluorescent display device employing the quadplex anode matrix scheme, the wiring pattern for the anode connection terminal accepting a positive voltage and the wiring pattern for the anode connection terminal accepting a negative voltage are arranged alternately. Anodes to be light emitted simultaneously are alternately connected to the anode connection terminals. For that reason, when a positive voltage is applied to the anode connection terminal to light emit an anode, a capacitance occurs between the wiring patterns for adjacent anode connection terminals. This causes the phenomenon where the current is charged into the capacitance.

In further explanation, a positive voltage is applied to the anode connection terminal AT1-1, AT1-4, the capacitance C, as shown in FIG. 16, occurs between the anode connection terminal AT1-1, AT1-4 and the wiring pattern for the anode connection terminal AT1-2, AT1-3 to which a negative voltage is applied. That is, the capacitance C occurs between all the anode connection terminals AT1-1, AT1-2, AT1-3, and AT1-4. Thus, a current is charged to each capacitance C.

The current charging the each capacitance C does not contribute to the light emission of the fluorescent display device. The peak current excessively heats the anode driver circuit that supplies the voltage to the anode connection terminals AT1-1, AT1-2, AT1-3, and AT1-4.

In the small fluorescent display devices, because the wiring pattern to each anode connection terminal is smaller and shorter, the capacitance between wiring conductors viewed from the anode driver circuit is not enough to heat the anode driver circuit. However, with the fluorescent display devices large-sized, the wiring pattern lengthened to each anode connection terminal tends to increase the influence due to heat generation, compared with the conventional small fluorescent display devices.

With the large-sized fluorescent display devices having the above anode connection configuration, the anode connection has the problem in that heat loss occurs in the anode driver circuit. That is, when two adjacent columns of anodes to a predetermined row glow, the capacitance produced between the wring patterns for all anode connection terminals is charged with current. The capacitance viewed from the anode driver circuit becomes large. The peak current of the charging current largely heats the anode driver circuit, thus causing a heat loss.

In order to solve that problem, the present applicant filed a fluorescent display device having an improved anode connection configuration (Japanese Patent Laid-open Publication No. Hei 10-55772).

FIG. 17 schematically shows the anode wiring in the fluorescent display device employing a quadplex anode matrix scheme, disclosed in the publication No. Hei 10-55772.

Referring to FIG. 17, numerals 1G, 2G, 3G, . . . represent grids, respectively. Numerals 1-2, 1-3, 1-1, 1-4, 2-2, 2-3, 2-1, 2-4, . . . represent anode wiring conductors, respectively. It is noted that anode segments 1-1, 1-2, 1-3 and 1-4 are arranged in numerical order in the wiring direction but anode wiring conductors 1-2, 1-3, 1-1 and 1-4 are arranged irregularly.

The irregular arrangement of the anode wiring conductors is inconvenient when the anode driver circuit drives them. That is, in order to solve the heat generation of the anode driver circuit caused by the capacitance between wiring patterns, the irregular anode connection structure shown in FIG. 16 has to be employed. Moreover, in the case of the quadplex anode matrix scheme, the restriction on designing a fluorescent display device makes it impossible to rearrange the anode wiring patterns according to the arrangement order of anodes.

The configuration and the driving method of the conventional anode driver circuit, which is used for fluorescent display devices in the quadplex anode matrix scheme, using the irregular anode connection as shown in FIG. 17 will be described below.

FIG. 18 is a timing chart when a fluorescent display device in the quadplex anode matrix scheme is driven. FIG. 19 is a table listing timing data for grid scanning. FIG. 20 is a matrix table listing an anode segment to be light emitted in conjunction with grid timing. FIG. 21 is a schematic diagram of an anode driver circuit. FIG. 22 is diagram showing an example of connections between driver outputs Q and anode segments. FIG. 23 is a drive timing chart for a conventional anode driver.

The driving scheme called the dual grid scanning is used as the grid driving method for a fluorescent display device in a multiple anode matrix scheme (e.g. in a quadplex anode matrix scheme). That is, as shown by the timing chart in FIG. 18 and the timing data in FIG. 19, grids are scanned one by one while two grids are being always turned on (in the order of grids G1, G2→G2, G3, →G3, G4). The grid timing when grids are scanned one by one is called the grid timing (T1 to Tn in FIG. 18).

Anodes are driven in synchronous with the grid timing, thus being light emitted. FIG. 20 is a matrix table for anode segments to be light emitted with the grid timing. Referring to FIG. 20, symbol ○ represents an anode segment to be light emitted. Symbol X represents no anode segment to be light emitted.

Referring to FIG. 20, if anode segments (X) glow, leakage of light occurs during displaying, thus degrading the display quality. In avoid such a phenomenon, the display data must be set to "L" to bring anode segments (X) to a non-glow state al all times. The anode segments (○) glow when the display data is "H" but does not glow when the display data is "L".

However, in the anode driver circuit in accordance with the conventional driving scheme, display data "L" are transferred to anode segments (X) shown in FIG. 20. For that reason, the RAM has to store display data for anode segments (X) shown in FIG. 20. The display data corresponding to anode segments (X) do not directly engage in selection of display lighting, thus becoming wasteful. Storing unnecessary data increases the capacity of the RAM. As a result, the RAM capacity is restricted because of the problem on costs, the capacity usable for other purposes (e.g. for gray level display) is reduced. Moreover, in the conventional anode driver circuit, the number of bits of display anode data transferred with each grid timing becomes n×4. Hence, in the case where the transfer of data for the anode segments (X) are omitted, the transfer rate, which corresponds to the bit number twice the number of the omitted transfer bits (in this example, n×2), is required.

As shown in FIG. 21, the anode driver circuit, which drives a fluorescent display device in a quadplex anode matrix scheme, is generally called a shift register, latch and driver, including a shift register, a latch, and an anode driver. In the anode driver circuit, the display data (anode data), as shown in FIGS. 21 and 22, is synchronized with the clocks input to the serial clock CLK and then is input from the serial input SI via the clock synchronous serial interface. The display data is transferred to necessary bits, or up to n bits of the shift register 31. Then, the latch circuit 32 holds the data from the shift register 31 in response to the latch LAT. The data held in the latch circuit 32 controls the outputs Q of the output circuit (anode driver) 33. The outputs Q of the anode driver 33, as shown in FIG. 22, are input to target anode segments in the fluorescent display device. Referring to FIG. 22, the output Q1 of the anode driver is input to the anode segment 1-2. The output Q2 of the anode driver is input to the anode segment 1-3. The output Q3 of the anode driver is input to the anode segment 1-1. The output Q4 of the anode driver is input to the anode segment 1-4.

In the shift register 31 of the anode driver circuit, anode data is sequentially input to the serial input SI and then is sent from R1 to R2, R3, , . . . and Rn. The registers R1, R2, R3, . . . correspond to the driver output Q1, Q2, Q3, . . . , respectively. However, the anode wiring conductors in the fluorescent display device are arranged irregularly, as described previously. For that reason, the problem is that the anode data must be transferred in consideration with the irregular arrangement of the anode wiring conductors.

If the order of the anode wiring conductors cannot be changed, the driver outputs are rearranged without any trouble. However, such an approach is specialized for only the quadplex anode matrix scheme, but cannot be employed for other anode matrix schemes (for example, the simple, duplex, and octuplex anode matrix schemes). That is, the problem is that the data format depends on the drive scheme and that drivers in all types of drive schemes cannot be used in common, so that the versatility cannot be provided.

For reference, FIG. 24 shows a table listing the terminal functions of a conventional anode driver. FIG. 25 illustrates connections between anode segments and the registers R of the shift register in the conventional anode driver.

SUMMARY OF THE INVENTION

The present invention is made to solve the above-mentioned problems.

An advantage of the invention is to provide a multiplex anode driver circuit capable of reducing the anode data memory capacity by removal of unnecessary data, thus improving the anode data transfer rate.

Another advantage of the present invention is to provide a multiplex anode driver circuit capable of using in common driver circuits in various driving schemes, without depending on software, and thus enabling small-sized hardware.

Further another advantage of the present invention is to provide a fluorescent display device, which employs the above-mentioned multiplex anode driver circuit.

In an aspect of the present invention, a multiplex anode driver circuit suitable for a fluorescent display device, the fluorescent display device including dot-like anodes arranged in a matrix form and having surfaces each on which a fluorescent substance is coated, grids each confronting two columns of anodes, and cathodes confronting said grids, wherein anode data is input to a predetermined anode in synchronous with the timing when two adjacent grids are sequentially scanned in a direction of a row of anodes, comprises shift registers in a two system, formed of a first shift register being allocated to an even-numbered grid timing and to an odd numbered grid timing when the grids are scanned and second shift register being allocated to odd numbered grid timing when the grids are scanned; a first group of latch circuits respectively connected to registers in the first shift register, each for holding anode data of a corresponding register, and a second group of latch circuits respectively connected to registers in the second shift register, each for holding anode data of a corresponding register; and a memory for storing anode data to be input to the shift register; wherein while blanking input to the first group of latch circuits associated the first shift register and blanking input to the second group of latch circuits associated the second shift register are being alternately released, the odd-numbered grid timing and the even-numbered grid timing are selected, so that anode data is transferred from the memory.

In the multiplex anode driver circuit, when a drive scheme is selectively set from among a simple anode matrix scheme, a duplex anode matrix scheme, a quadplex anode matrix, and an octuplex anode matrix scheme, the shift registers in a two system are selectively connected in conjunction with a selected drive scheme to obtain drive outputs corresponding to the wiring state of the anodes, so that anode data is transferred.

In another aspect, the present invention relates to a fluorescent display device using a multiple anode driver circuit suitable, the fluorescent display device including dot-like anodes arranged in a matrix form and having surfaces each on which a fluorescent substance is coated, grids each confronting two columns of anodes, and cathodes confronting the grids, wherein anode data is input to a predetermined anode in synchronous with the timing when two adjacent grids are sequentially scanned in a direction of a row of anodes. The multiplex anode driver circuit comprises shift registers in a two system, formed of a first shift register being allocated to an even-numbered grid timing and to an odd numbered grid timing when the grids are scanned and second shift register being allocated to odd numbered grid timing when the grids are scanned; a first group of latch circuits respectively connected to registers in the first shift register, each for holding anode data of a corresponding register, and a second group of latch circuits respectively connected to registers in the second shift register, each for holding anode data of a corresponding register; and a memory for storing anode data to be input to the shift register. While blanking input to the first group of latch circuits associated the first shift register and blanking input to the second group of latch circuits associated the second shift register are being alternately released, the odd-numbered grid timing and the even-numbered grid timing are selected, so that anode data is transferred from the memory.

In the fluorescent display device, when a drive scheme is selectively set from among a simple anode matrix scheme, a duplex anode matrix scheme, a quadplex anode matrix and an octuplex anode matrix scheme, the multiplex anode driver circuit selectively connects said shift registers in a two system, in conjunction with a selected drive scheme, to obtain drive outputs corresponding to the wiring state of said anodes, and then transmits anode data.

BRIEF DESCRIPTION OF THE DRAWINGS

This and other features and advantages of the present invention will become more apparent upon a reading of the following detailed description and drawings, in which:

FIG. 10 is a code table listing connections between respective serial inputs and registers;

FIG. 11 is a code table listing connections between a serial input and registers;

FIG. 13 is a code table listing connections between respective blanking terminals and driver output stages;

FIG. 14 is a code table listing connections between a blanking terminal and driver outputs;

FIG. 19 is a table listing timing data for grid scanning;

FIG. 20 is a matrix table for anode segments to be lit in conjunction with grid timing;

FIG. 24 is a table listing the terminal functions of a conventional anode driver; and FIG. 25 is a table listing connections between registers R of a shift register and anode segments in a conventional anode driver.

DESCRIPTION OF THE EMBODIMENTS

A multiple anode driver circuit according to the present invention is used for fluorescent display devices employing the anode matrix scheme. The basic configuration is the dual (or two-system) configuration that has a shift register allocated for odd-numbered grid timing and a shift register allocated for even-numbered grid timing.

In the multiple anode driver circuit, a logic switch can rearrange the driver outputs to select a multiple anode matrix scheme (including a simple, duplex, quadplex, or octuplex anode matrix scheme). In this mode selection, the outputs suitable for the arrangement of the anode wiring conductors in a driving scheme (e.g. in a simple, duplex, quadplex, or octuplex anode matrix scheme) can be obtained.

Before the multiple anode driver circuit will be described, the general configuration of a fluorescent display device in an anode matrix scheme, in which the multiple anode driver circuit is mounted, will be first described by referring to FIG. 1.

Figure 1:
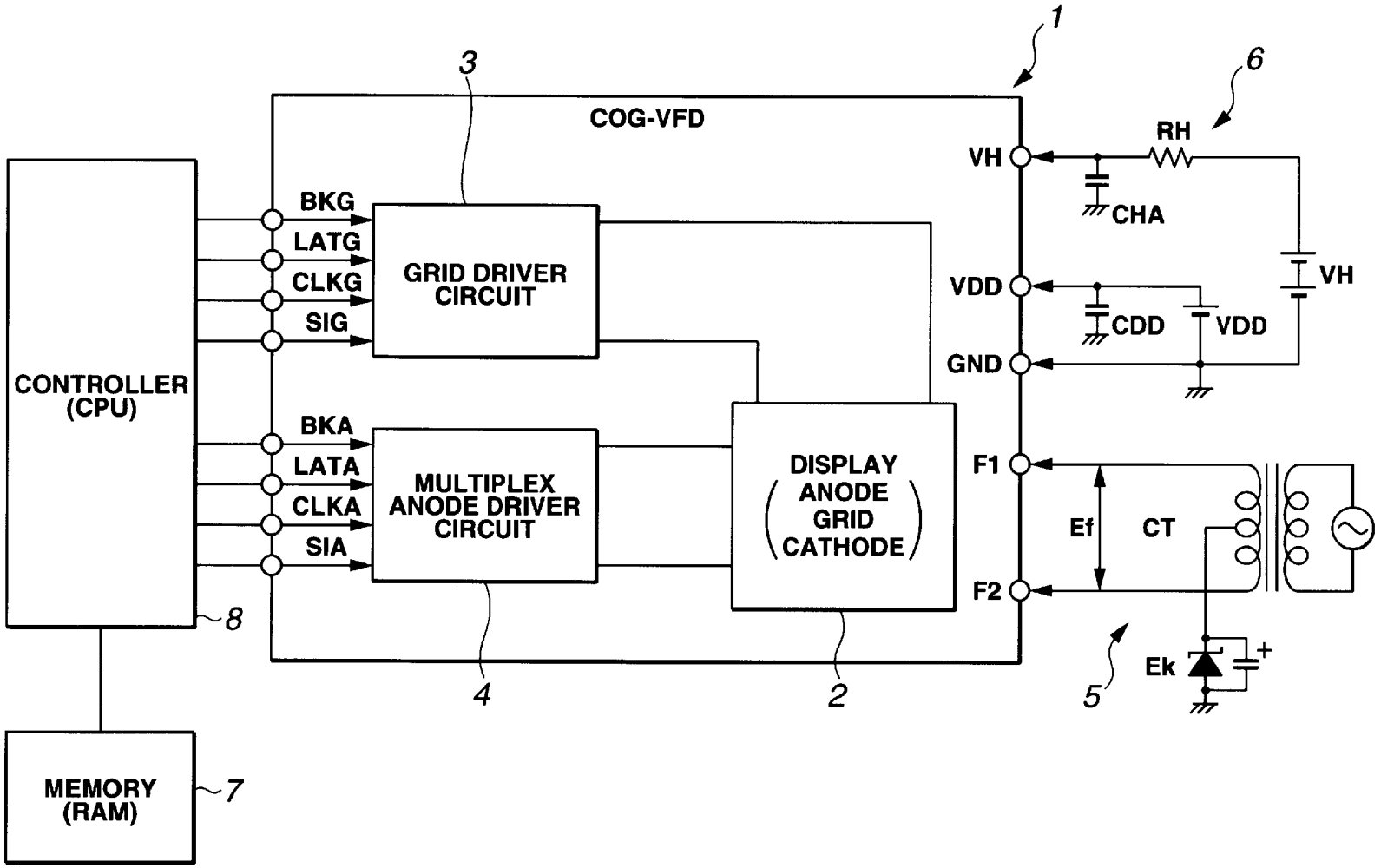
FIG. 1 is a block diagram illustrating a fluorescent display device to which a multiplex anode driver circuit according to the present invention is mounted.

Referring to FIG. 1, a chip-on-glass (COG) fluorescent display device 1 includes a display 2, a grid driver circuit 3, a multiple anode driver circuit 4 (a main constituent element in the present invention), a cathode driver circuit 5, a power source circuit 6, a memory 7, and a controller 8.

Figure 18:
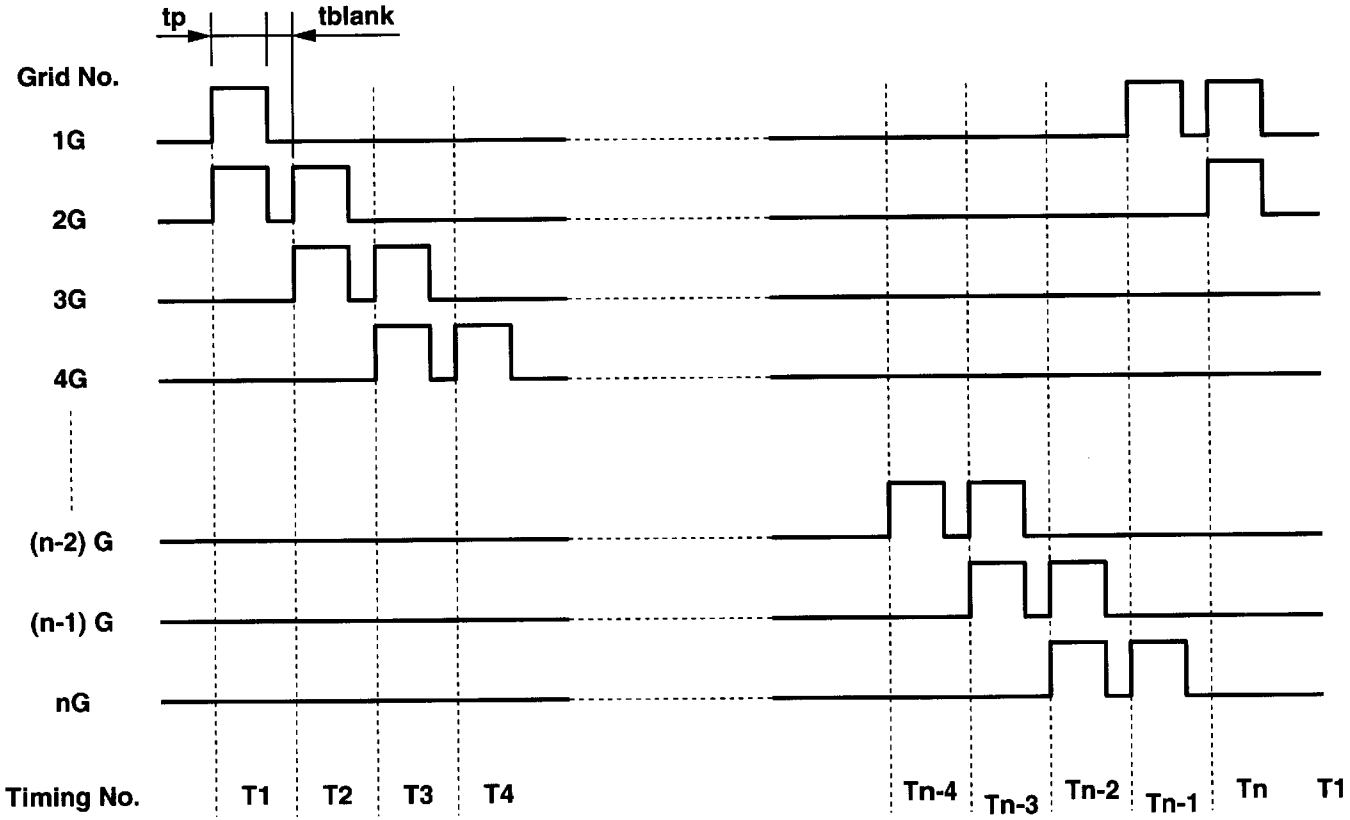
FIG. 18 is a timing chart for driving a fluorescent display device in a quadplex anode matrix scheme.
Figure 21:
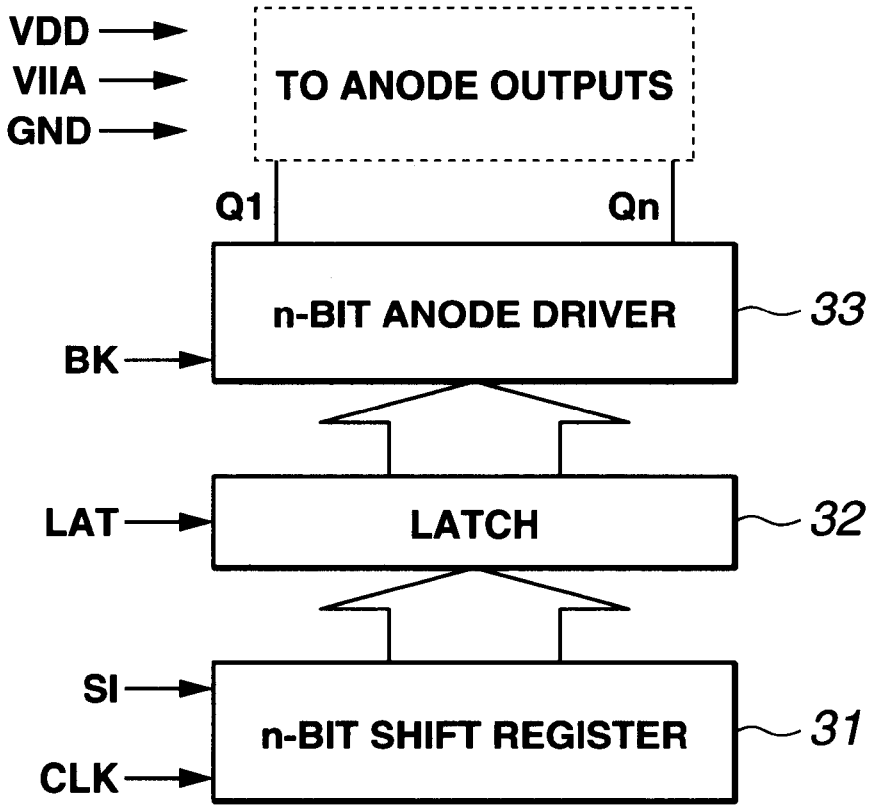
FIG. 21 is a diagram illustrating an anode driver circuit.
Figure 22:
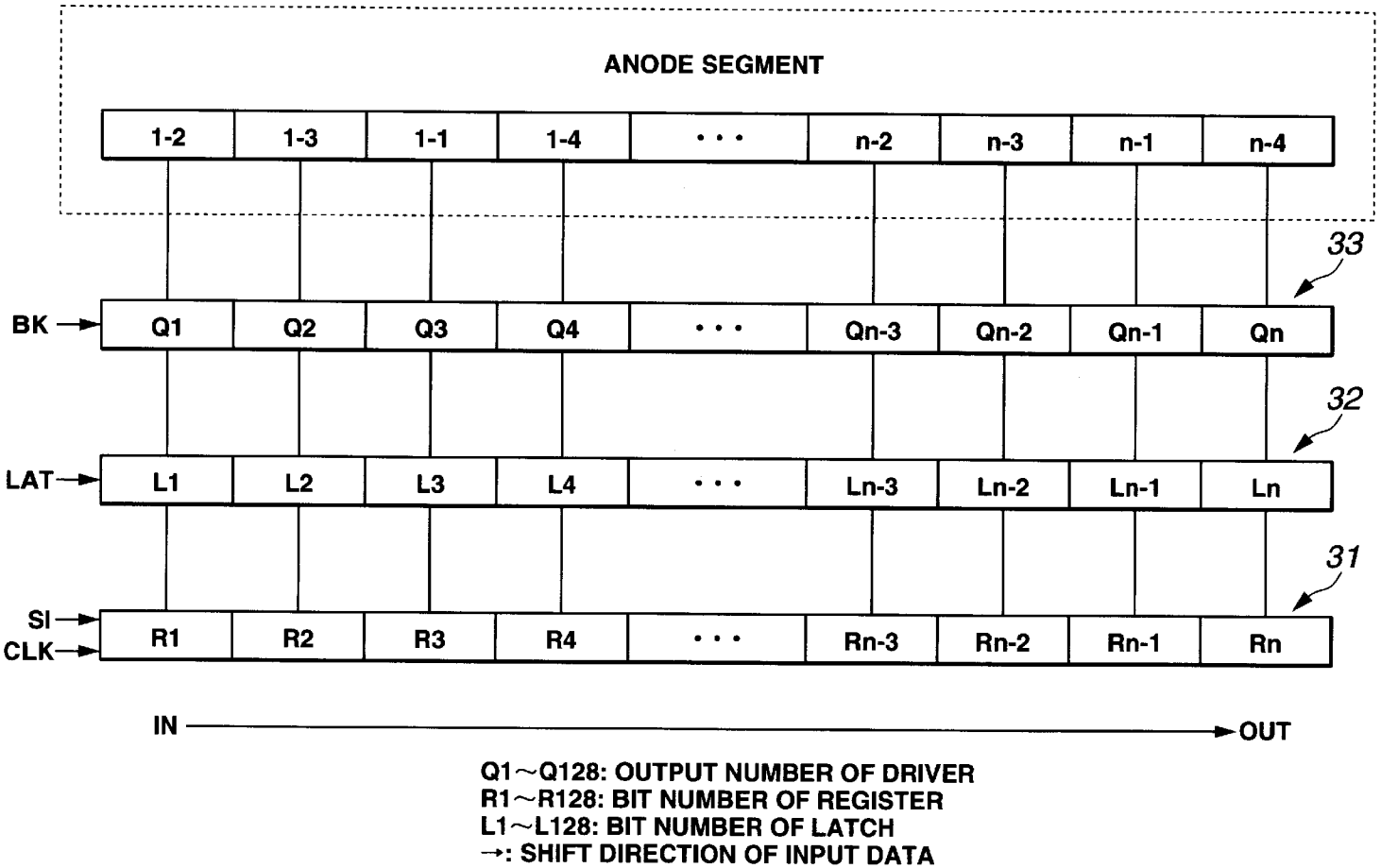
FIG. 22 is a diagram illustrating connections between driver outputs Q and anode segments.
Figure 23:
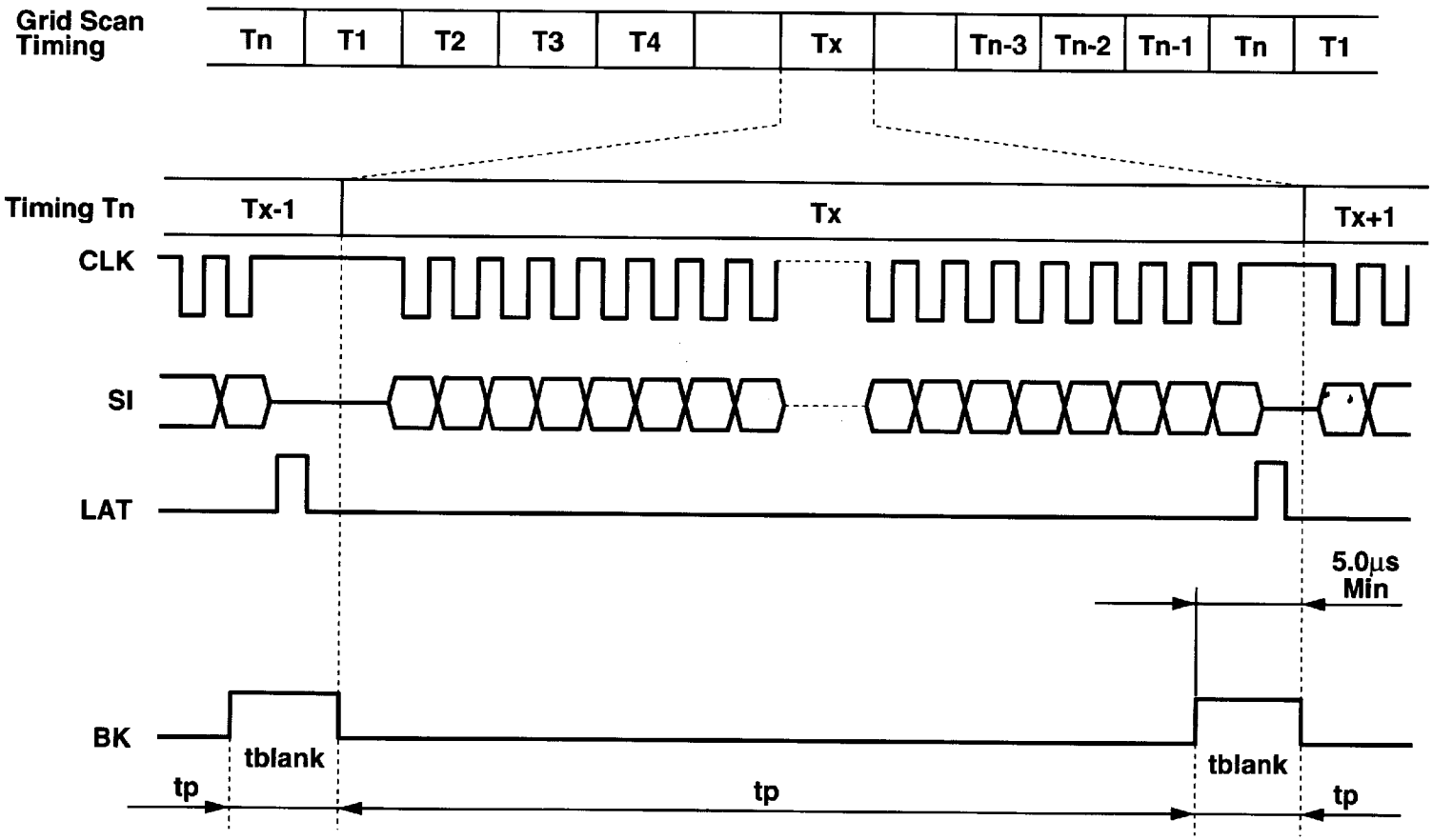
FIG. 23 is a drive timing chart of a conventional anode driver.

The display 2, which has a triode structure including an anode, a grid, and a cathode, has a predetermined display pattern. The grid driver circuit 3 scans grids based on the clock CLK, the serial input SIG, the latch LATG, and the blanking BKG, which are output from the controller 8. In other words, as shown with the timing chart in FIG. 18 and with the timing data in FIG. 19, the grid driver circuit 3 scans grids one by one with the timing (or, with the grid timing T), while two grids are being always turned on.

In further explanation, when two pluses, or "H" data, are input to the serial input SIG, data of the shift register corresponding to the outputs to the grids 1G and 2G become "H". The resultant data are output to the grids 1G and 2G in synchronous with the timing of the anode data via the latch LATG and via the blanking BKG. Next, the serial input SIG receives one pulse corresponding to "L" data. The data of the shift register corresponding to the output of the grid 2G and the data of the shift register corresponding to the output of the grid 3G become "H" together. The resultant data are output to the grids 2G and 3G in synchronous with the timing of the anode data via the latch LATG and via the blanking BKG. Next, when one pulse, or "L" data, is input to the serial input SIG, the data of the shift register corresponding to the output to the grid 3G becomes "H" and the data of the shift register corresponding to the output to the grid 4G becomes "H". The resultant data are output to the grids 3G and 4G in synchronous with the timing of anode data and via the latch LATG and via the blanking BKG. By repeating these operations, the grids G1 to Gn are selectively driven.

The multiplex anode driver circuit 4 transfers anode data based on the clock CLKA, the serial input SIA, the latch LATA, and the blanking BKA, which are input by the controller 8. This operation will be explained in detail later.

Each cathode (not shown), formed of a filament cathode, emits from the surface thereof through the heating and driving operation of the cathode drive circuit 5. The power source circuit 6 supplies drive power sources necessary for various portions. The memory (display RAM) 7 stores original display data (anode data) for desired displays on the display 2. The controller (CPU) 8 comprehensively controls the drive operation of the grid driver circuit 3 and the multiplex anode driver circuit 4.

Referring to FIG. 1, the controller 8 inputs the clock CLK, the serial input SI, the latch LAT and the blanking BK to the grid driver circuit 3. The controller 8 further inputs the clock CLK, the serial input SI, the latch LAT and the blanking BK to the multiplex anode driver circuit 4. Letter G are attached to the ends of signal names relating to grids and letter A is attached to ends of signal names relating to anodes.

Figure 17:
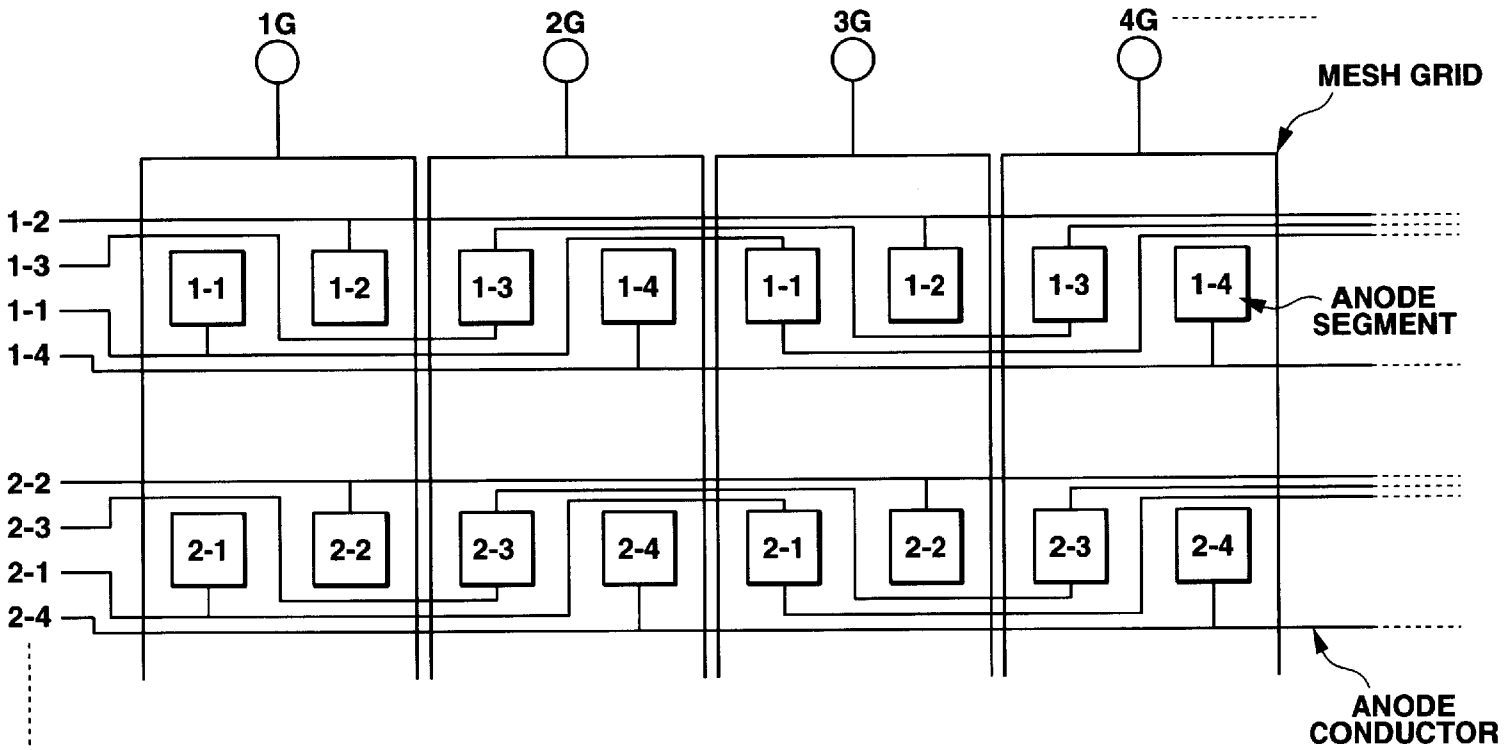
FIG. 17 is a schematic diagram showing an anode wiring layout in a fluorescent display device employing a quadplex anode matrix scheme, disclosed in Japanese Patent Laid-open publication No. Hei 10-55772.

In the fluorescent display device 1, plural anodes are arranged in a matrix form, which has plural rows of anodes or plural columns of anodes. Each row has a plurality of anodes while each column has a plurality of anodes. The plural rows of anodes or the plural columns of anodes are spaced away from each other a predetermined distance. Each anode is a dot-like anode having the surface on which a fluorescent substance is coated. Each dot-like fluorescent substance forms a display dot which light emits by impingement of thermal electrons emitted from a cathode. When the driving scheme is the quadplex anode matrix scheme, the anode wiring connection configuration shown in FIG. 17 is employed.

Figure 2:
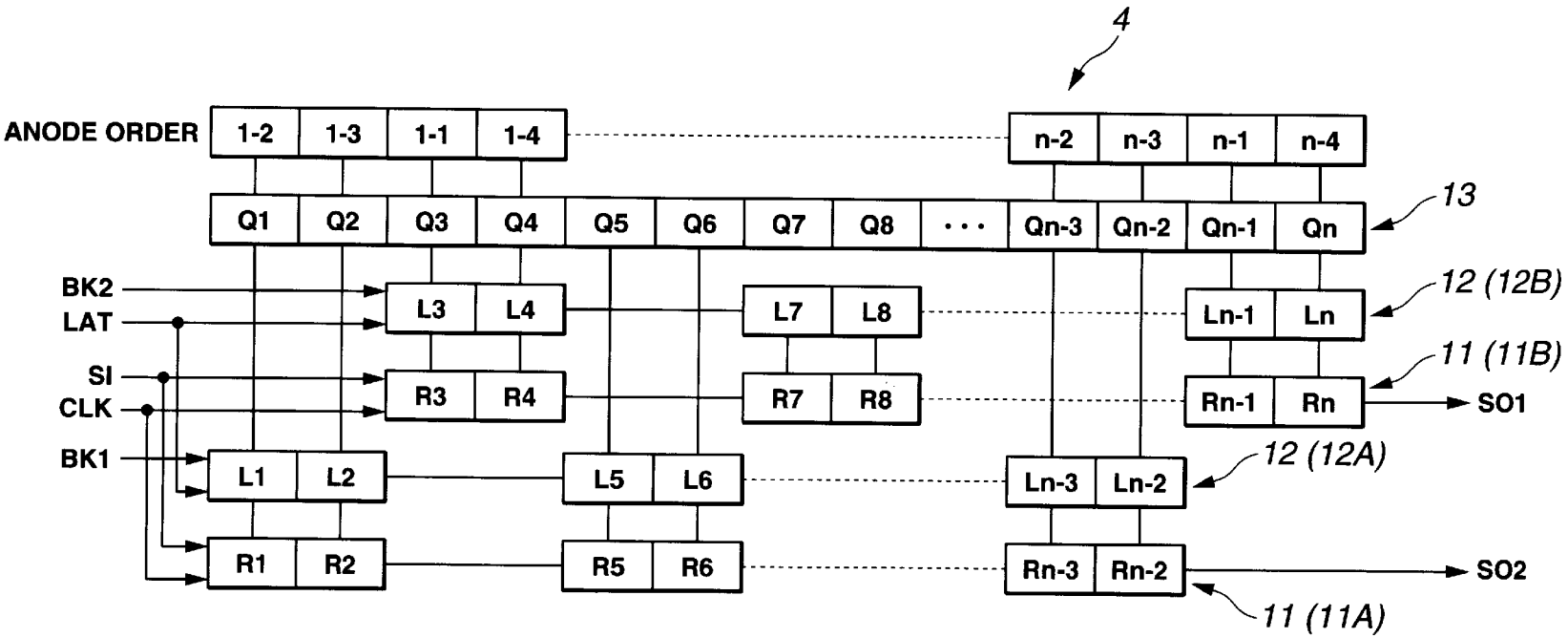
FIG. 2 is a circuit diagram illustrating a multiplex anode driver circuit according to a first embodiment of the present invention.
Figure 3:
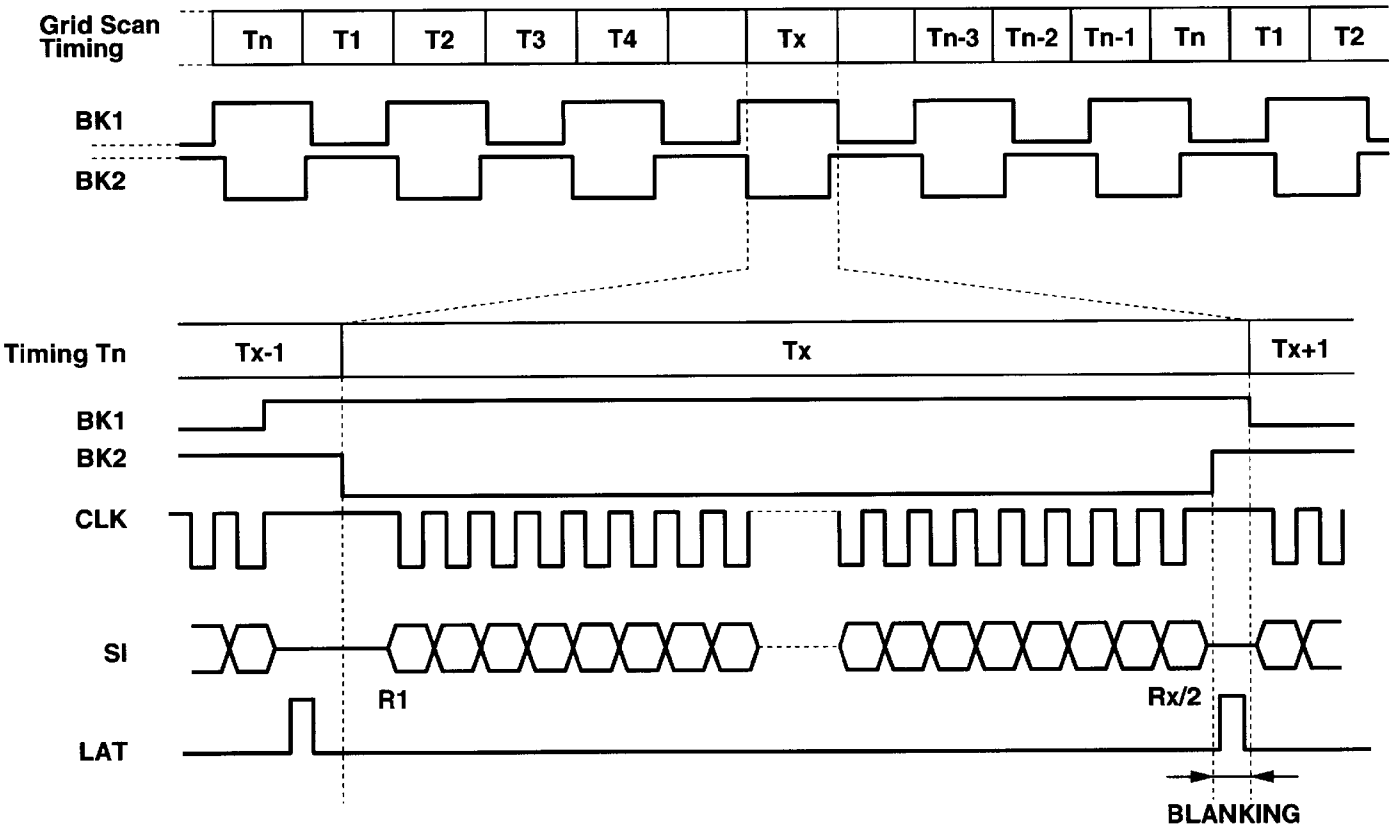
FIG. 3 is a drive timing chart of the circuit configuration shown in FIG. 2.

Next, the multiplex anode driver circuit according to a first embodiment of the present invention will be explained below. FIG. 2 is a circuit diagram illustrating a multiplex anode driver circuit according to the first embodiment of the present invention. FIG. 3 is a drive timing chart for the circuit configuration of FIG. 2.

A multiplex anode driver circuit employed a fluorescent display device in a quadplex anode matrix scheme (shown in FIG. 17) will be explained as a drive scheme example.

As shown in FIG. 2, the multiplex anode driver circuit 4 according to the first embodiment has two systems of shift registers 11 (11A and 11B). When shift registers 11A and 11B are used for the fluorescent display device in a quadplex anode matrix scheme, the registers corresponding the portions (X) shown in FIG. 20 are omitted but only the registers corresponding to the portions (○) shown in FIG. 20 are connected together. That is, as shown in FIG. 2, the shift register 11A is formed of the registers R1, R2, R5, R6, . . . , Rn-3, and Rn-2 corresponding to the odd-numbered grid timing T1, T3, . . . The shift register 11B is formed of the shift registers R3, R4, R7, R8, . . . , Rn-1, and Rn corresponding to the even-numbered grid timing T2, T4, . . .

The controller 8 inputs the clock CLK and the serial input SI to the registers R1 to Rn in the shift register 11A, 11B. As shown in FIG. 2, in the shift registers 11A and 11B, the serial input SI corresponding to the odd-numbered grid timing and the serial input SI corresponding to the odd-numbered grid timing are input in common. Thus, the same anode data are always transferred from the memory 7 to the shift registers 11A and 11B.

The latch circuit 12 (L1 to Ln) is connected to the registers R1 to Rn in the shift register 11A, 11B, the output circuit 13 (Q1 to Qn) is connected to the latch circuits L1 to Ln. The controller 8 inputs the latch LAT and the blanking BK1 to the latch circuit 12A (L1, L2, L5, L6, . . . , Ln-3, Ln-2) connected to the shift register 11A for odd-numbered grid timing. The controller 8 inputs the latch LAT and the blanking BK2 to the latch circuit 12B (L3, L4, L7, L8, . . . , Ln-1, Ln) connected to the shift register 11B for even-numbered grid timing. In other words, the blanking terminal for the odd-numbered grid timing and the blanking terminal for the even-numbered grid timing are provided to select the drive output of the multiplex anode driver circuit 4. This enables the driver output selection.

For example, When anode data is transferred from the memory 7 with an odd-numbered timing, the odd-numbered shift register 11A latches it. Thereafter, the blanking BK1 of the odd-numbered shift register 11A is released, the anode data corresponding to the odd-numbered grid timing is output. During this operation, the blanking BK2 of the even-numbered shift register 11B has to be set in a blanking state, as shown in FIG. 3.

As described above, in the multiplex anode driver circuit 4 according to the first embodiment, the shift register 11 is divided into two systems, namely a shift register for odd-numbered grid timing and a shift register for even-numbered grid timing. The odd-numbered grid timing and the even-numbered grid timing are selected while the blanking BK1 input to the shift register 11A and the blanking BK2 input to the shift register 11B are being released alternately, so that anode data is transferred.

In the register configuration of the multiplex anode driver circuit 4 of the present embodiment, the number of registers is equal to that in the register configuration of the conventional anode driver circuit. However, the registers per shift register can be halved in number. With the grid timing at a constant cycle, the number of transfer bits per grid timing can be halved, so that the transfer rate can be halved to the conventional transfer rate. Moreover, general-purpose components can be used and be broadly chosen for the anode driver circuit.

Because the anode data is halved, the display data memory capacity of the memory 7 can be reduced. Even if the RAM capacity is restricted due to costs, a small capacity RAM can be used as the memory 7. When the capacity of the memory 7 is equal to that in the conventional anode driver circuit, the memory capacity corresponding to the reduced anode data can be used, for example, as a data area for gray scale display or for other applications.

Figures 4A, 4B, 4C:
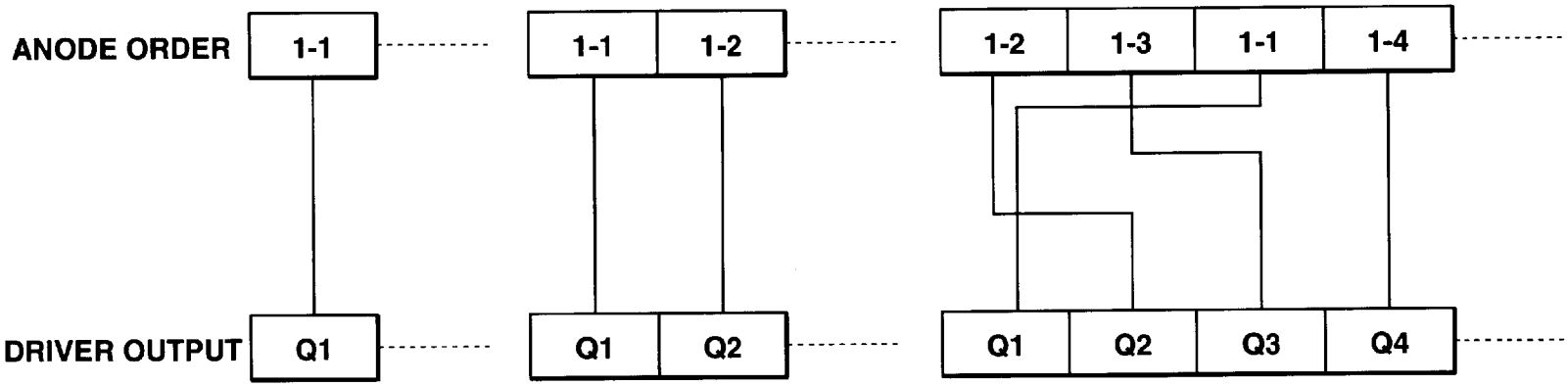
FIGS. 4(*a*), 4(*b*) and 4(*c*) are diagrams each showing an anode matrix scheme of a conventional fluorescent display device as well as connection relationships between driver outputs.
Figure 5:
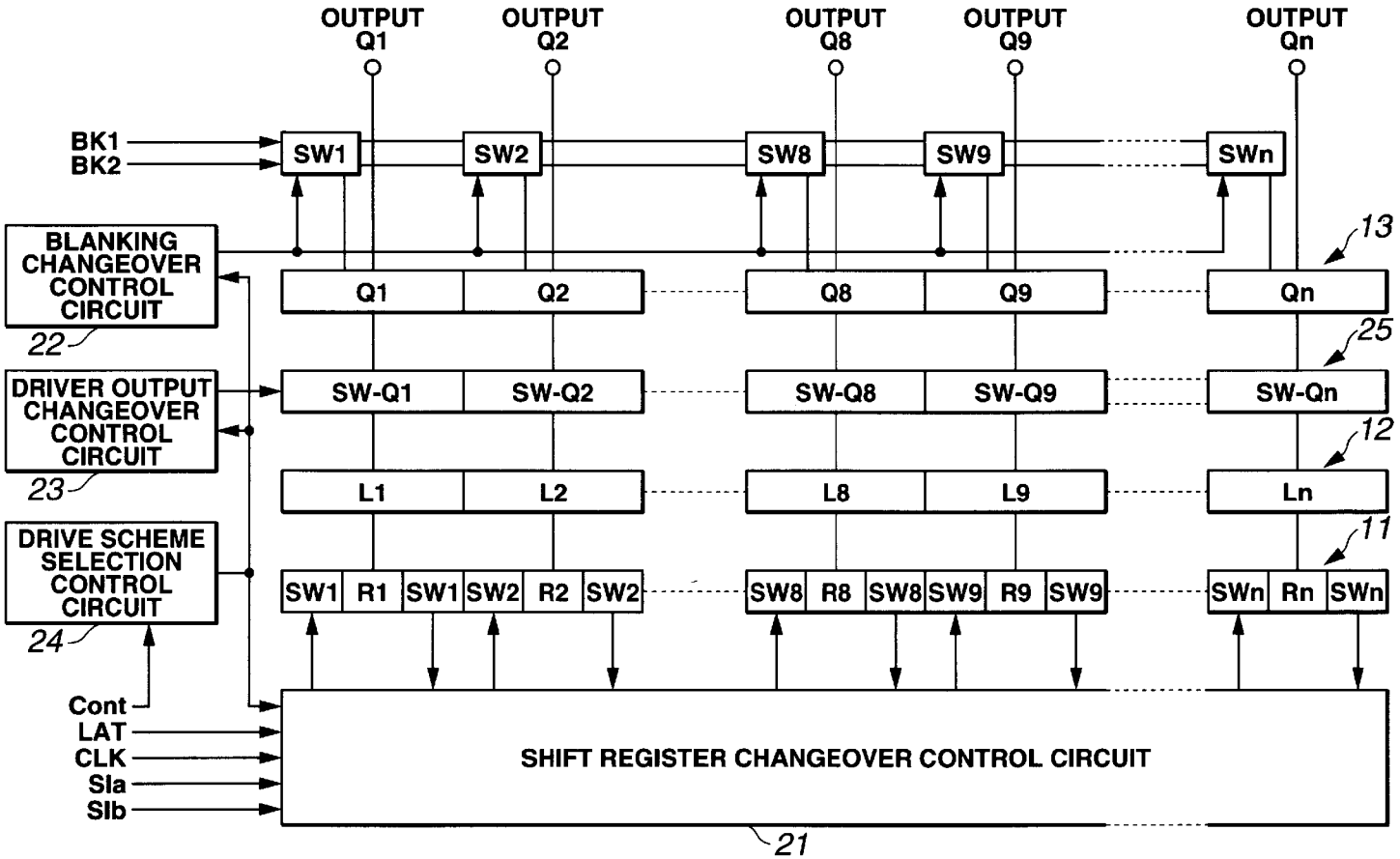
FIG. 5 is a circuit diagram illustrating a multiplex anode driver circuit according to a second embodiment of the present invention.
Figure 6:
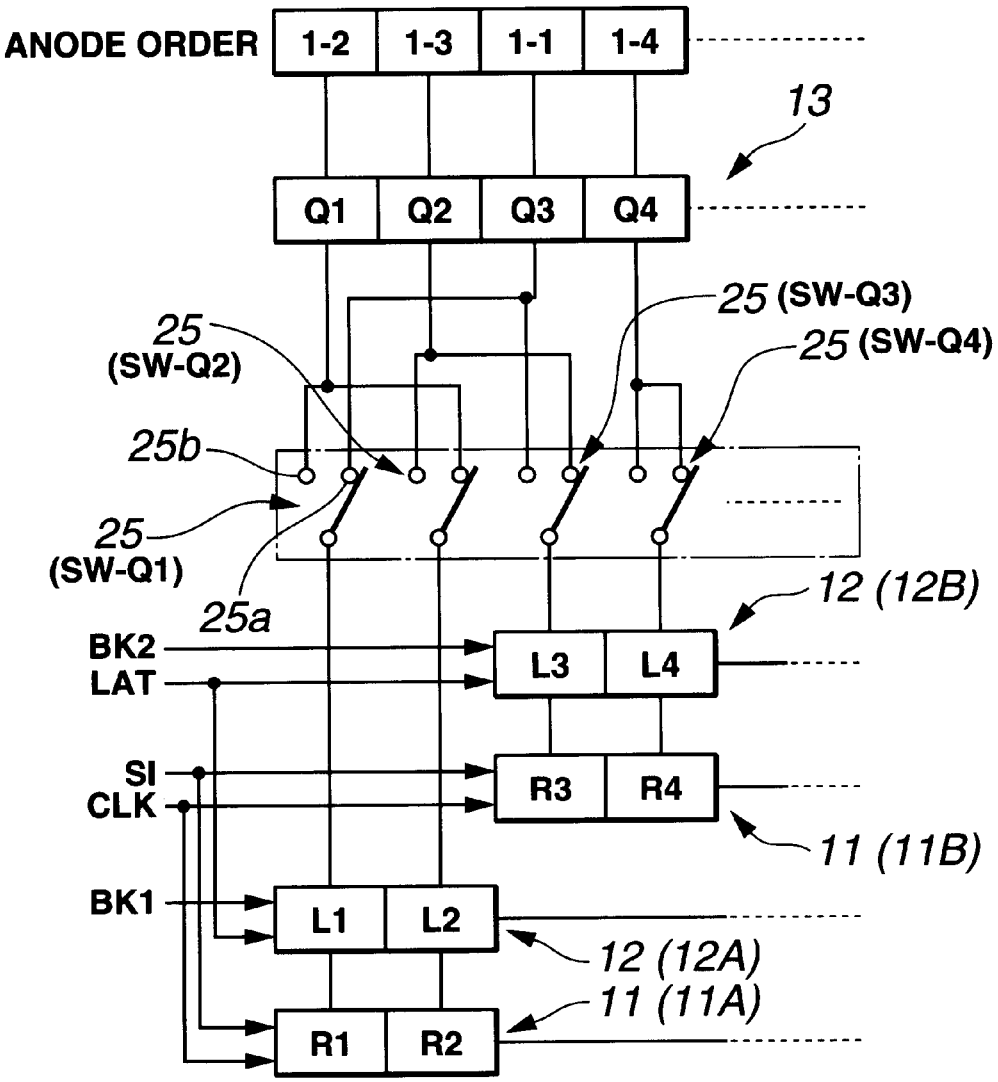
FIG. 6 is a diagram illustrating a driver-output connection changeover circuit.
Figure 7B:
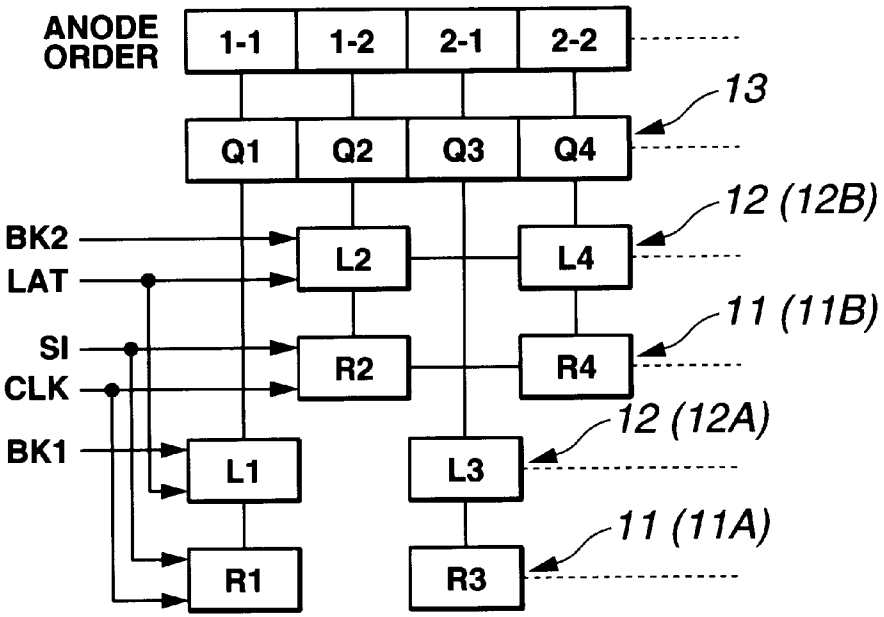
FIG. 7(*a*) is a diagram showing a shift register in a simple anode matrix scheme of a fluorescent display device and FIG. 7(*b*) is a diagram showing a shift register in a duplex anode matrix scheme of a fluorescent display device.
Figure 7A:
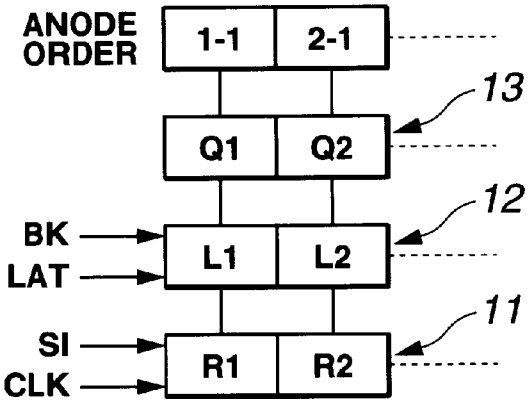
Figure 8B:
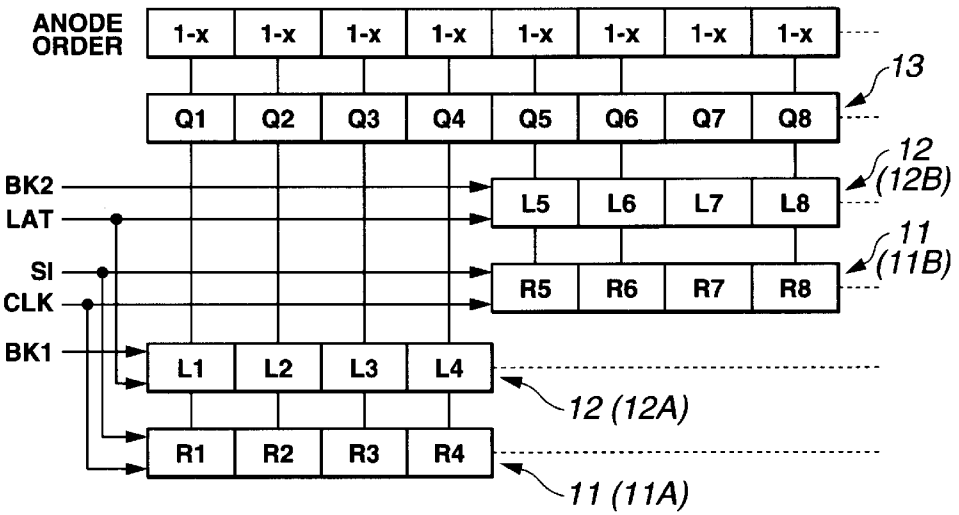
FIG. 8(*a*) is a diagram showing a shift register in a quadplex anode matrix scheme of a fluorescent display device and FIG. 8(*b*) is a diagram showing a shift register in a octuplex anode matrix scheme of a fluorescent display device.
Figure 8A:
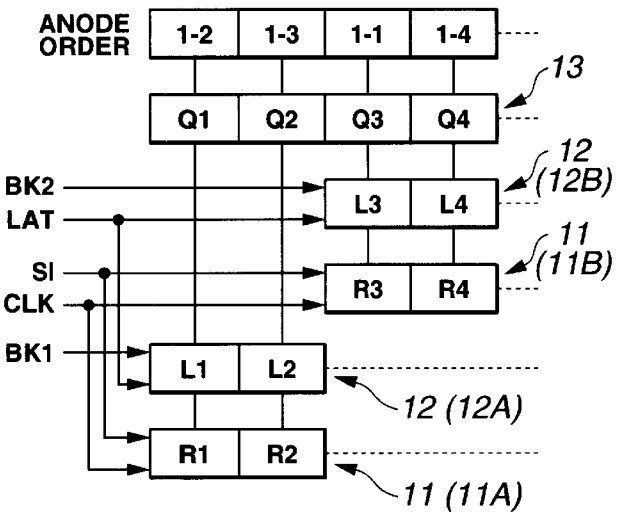
Figure 9:
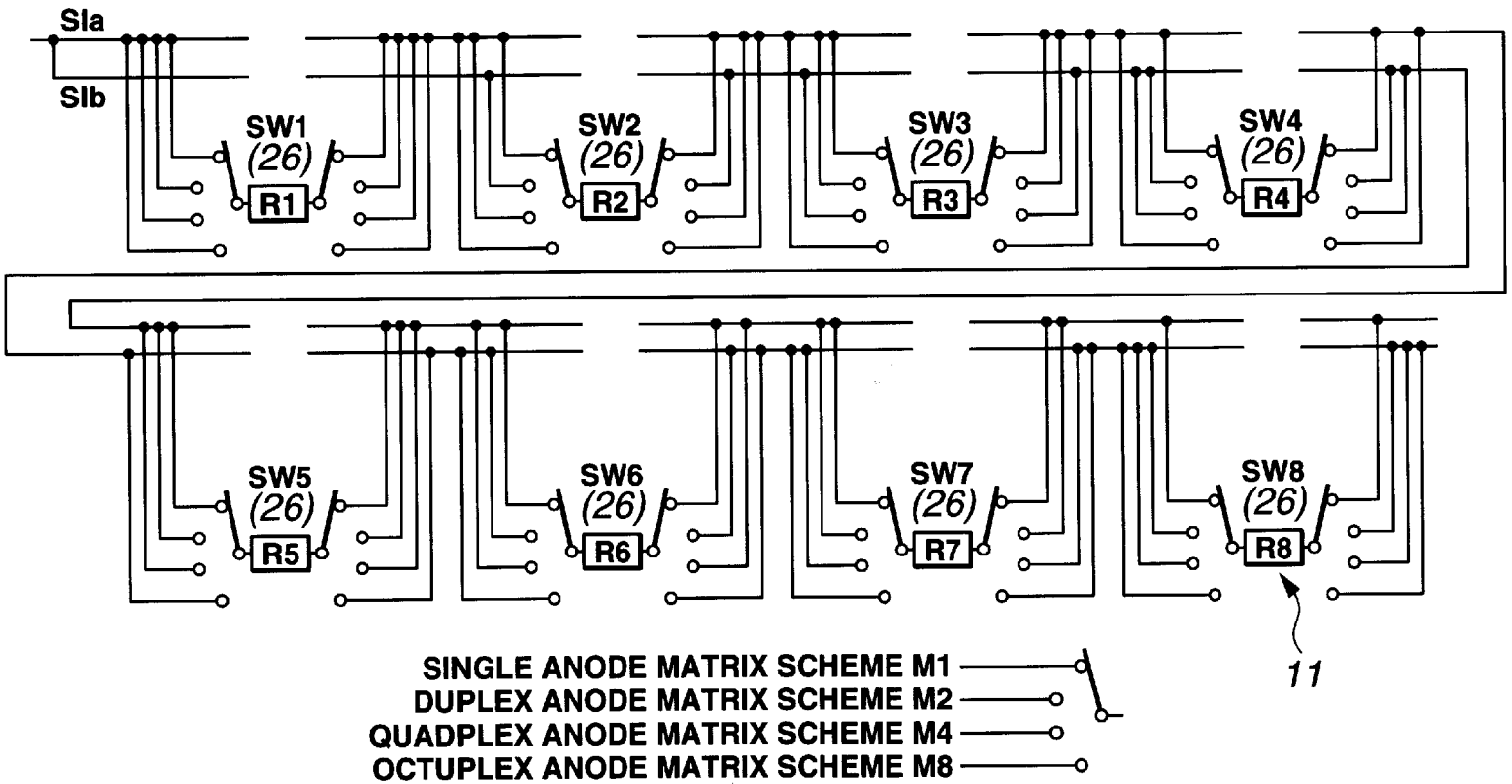
FIG. 9 is a diagram showing an example of connections between respective serial inputs and registers in an anode matrix scheme.
Figure 12:
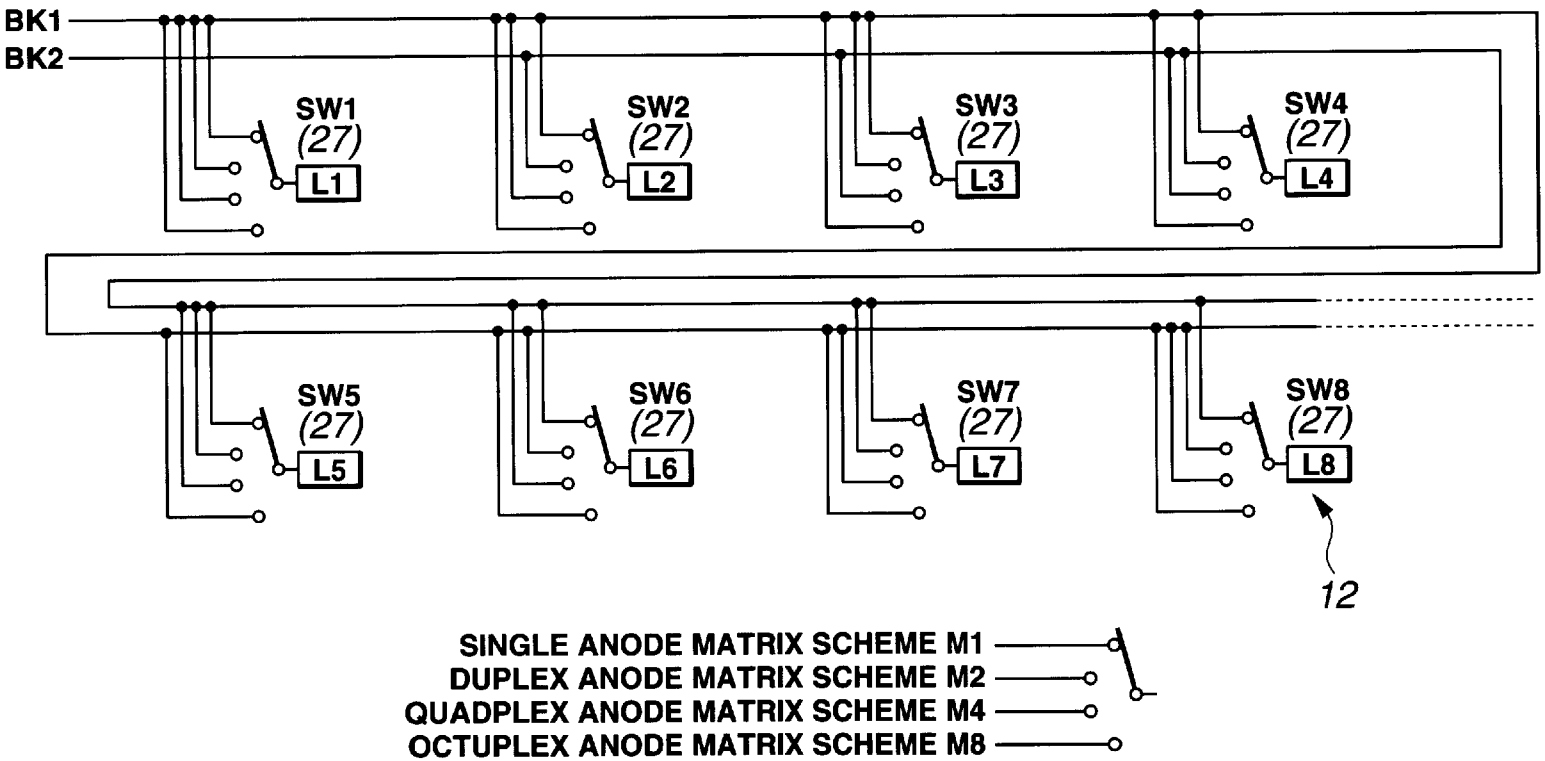
FIG. 12 is a diagram showing an example of connections between driver output stages and blanking terminals in an anode matrix scheme.
Figure 15:
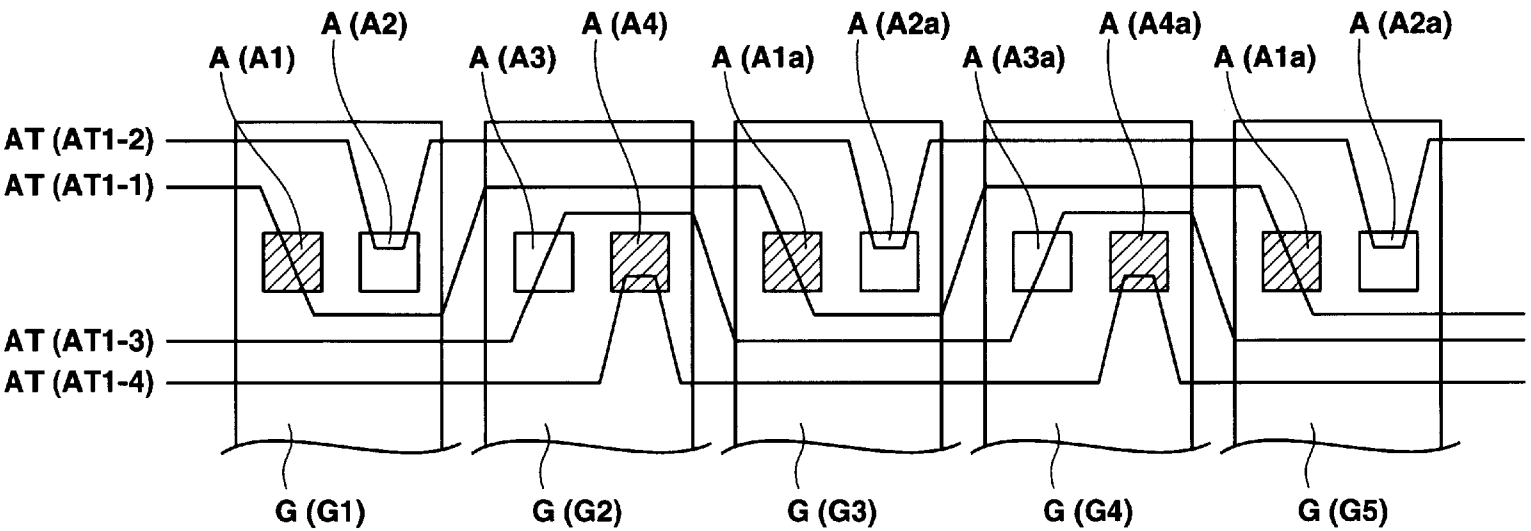
FIG. 15 is a diagram illustrating an anode connection configuration in a fluorescent display device employing a quadplex anode matrix scheme.
Figure 16:
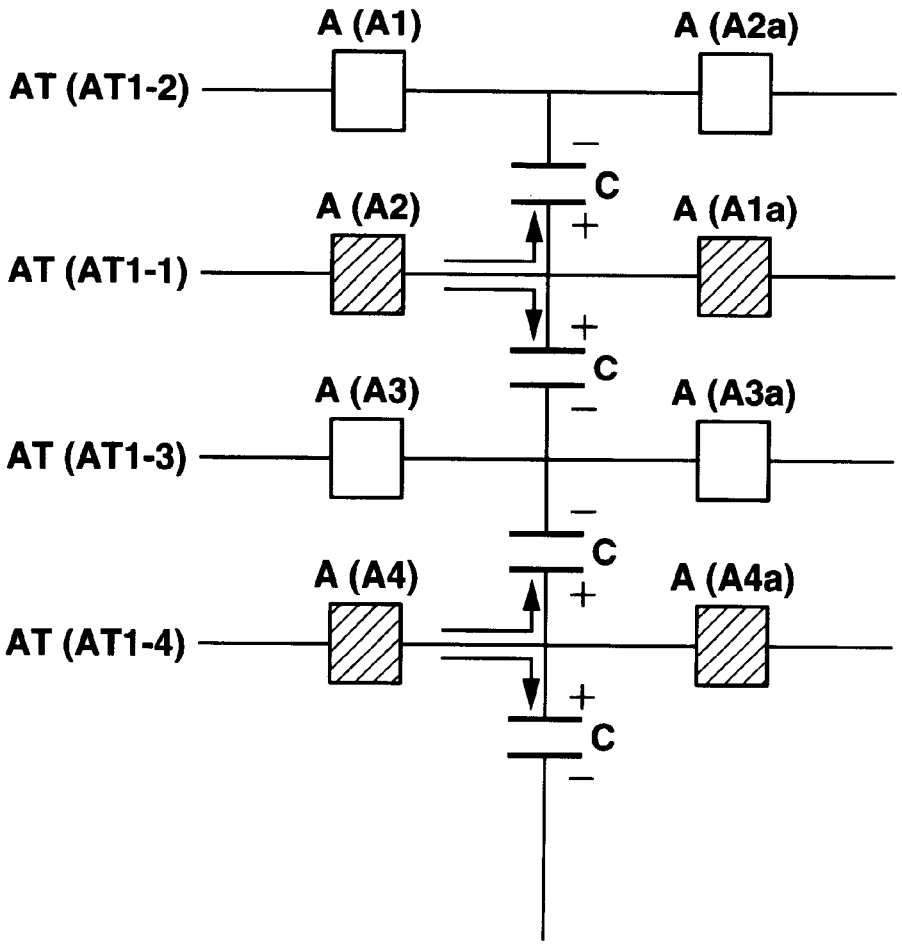
FIG. 16 is a wiring diagram of the circuit configuration of FIG. 15.

Next, the multiplex anode driver circuit according to a second embodiment of the present invention will be described below. FIGS. 4(*a*) to 4(*c*) are diagrams each illustrating an anode matrix scheme and a connection relationship between driver outputs, in a conventional fluorescent display device. FIG. 5 is a circuit diagram illustrating a multiplex anode driver circuit according to the second embodiment of the present invention. FIG. 6 is a diagram showing an example of a driver-output connection changeover circuit. FIG. 7(*a*) is a diagram illustrating a shift register in a single anode matrix scheme of a fluorescent display device and FIG. 7(*b*) is a diagram illustrating a shift register in a duplex anode matrix scheme of a fluorescent display device. FIG. 8(*a*) is a diagram illustrating the configuration of a shift register in a quadplex anode matrix scheme of a fluorescent display device and FIG. 8(*b*) is a diagram illustrating the configuration of a shift register in a octuplex anode matrix scheme of a fluorescent display device. FIG. 9 is a diagram illustrating connections between serial inputs and registers in an anode matrix scheme. FIG. 10 is a code table listing connections between respective serial inputs and registers. FIG. 11 is a code table listing connections between a serial input and registers. FIG. 12 is a diagram illustrating connections between driver output stages and blanking terminals in an anode matrix scheme. FIG. 13 is a code table listing connections between respective blanking terminals and driver output stages. FIG. 14 is a code table listing connections between a blanking terminal and driver output stages.

In the configuration of the first embodiment, the registers corresponding to portions (X) shown in FIG. 20 (or registers not related directly to displaying) are omitted. The number of bits of the memory (display RAM) 7 matches the number of dots of the display 2. This means that the quadplex anode matrix scheme is transformed to a simple anode matrix scheme.

However, in the fluorescent display device in the quadplex anode matrix scheme, the anode wiring conductors are arranged irregularly. Anode data have to be transferred in accordance with the irregular arrangement. This makes it difficult understand visually and leads to poor usability.

In the multiplex anode driver circuit 4 of the second embodiment, since the quadplex anode matrix scheme is equivalent to the simple anode matrix scheme, the driver outputs are connected in accordance with the arrangement of anode wiring conductors in the display 2. By doing so, the quadplex anode matrix scheme is completely equalized to the simple anode matrix scheme.

When the conventional anode driver circuit is used, each of the quadplex anode matrix scheme and the simple anode matrix scheme has the wiring configuration where the anode wiring conductors correspond to the driver outputs, respectively, as shown in FIGS. 4(*a*) and 4(*b*). That is, the anode segments are arranged in the order of the driver outputs.

In contrast, the quadplex anode matrix scheme has the wiring configuration where the anode wiring conductors does not correspond to the driver outputs, as shown in FIG. 4(*c*). That is, the anode segments are not arranged in accordance with the driver outputs. Consequently, the conventional anode driver circuit has the problem in that the usable drive schemes are limited.

In the multiplex anode driver circuit 4 of the present embodiment, the driver outputs are controllably changed in accordance drive schemes in such a way that a drive scheme is not dedicated to a specific drive scheme. The specific configuration will be described below.

As shown in FIG. 5, the multiplex anode driver circuit 4 includes a shift register 11, a latch circuit 12, an output circuit 13, a shift register changeover control circuit 21, a blanking changeover control circuit 22, a driver output changeover control circuit 23, and a drive scheme selection control circuit 24. Like numerals are attached to the same constituent elements as those in the first embodiment.

The multiplex anode driver circuit 4 produces suitable drive outputs in accordance with the anode wiring conductor in a drive scheme (or in a simple, duplex, quadplex, or octuplex anode matrix scheme).

The configuration of the first embodiment can simplify each anode matrix scheme and driver output connections in a fluorescent display device. In the multiplex anode driver circuit 4 of the second embodiment, the switches 25 (SW-Q1 to SW-Qn) is disposed between the latch circuit 12 and the output circuit 13. The driver output changeover control circuit 23 changes controllably each of the switches 25 (SW-Q1 to SW-Qn) so that the driver outputs can be selected in accordance with the drive scheme to be used.

For example, FIG. 6 illustrates the circuit where the switches 25 (SW-Q1 to SW-Qn) switch between the simple anode matrix scheme and the quadplex anode matrix scheme. Referring to FIG. 6, the contacts of the switches 25 (SW-Q1 to SW-Qn) are turned to the terminals 25*a* to select the duplex anode matrix scheme. On contrary, in order to select the quadplex anode matrix scheme, the contacts of the switches 25 (SW-Q1 to SW-Qn) are turned to the terminals 25*b*. In the example shown in FIG. 6, the switches 25 are in the state where the driver outputs are obtained in accordance with the anode wiring conductors in the quadplex anode matrix scheme.

As apparent from FIGS. 4(*a*) and 4(*b*), the connection in the simple anode matrix scheme is equal to the connection in the quadplex anode matrix scheme. Hence, the circuit shown in FIG. 6 can be also used as the duplex anode matrix scheme. The driver output changeover control circuit 23 operates the switches 25 (SW-Q1, SW-Q2, . . . ) in a synchronous mode.

The configuration of the shift register 11 depends on the drive scheme, in a manner similar to the drive output changing operation. FIGS. 7(*a*) and 7(*b*) and FIGS. 8(*a*) and 8(*b*) are structural diagrams each illustrating various configurations of the shift register 11. In the quadplex anode matrix scheme (previously described with FIG. (2), as shown in FIG. 8(*a*), the shift register 11 is divided every two stages such that the register 11A corresponds to an odd-numbered grid timing and that the register 11B corresponds to an even-numbered grid timing. In the duplex anode matrix scheme, as shown in FIG. 7(*b*), the shift register 11 is divided every stage such that the register 11A corresponds to an odd-numbered grid timing and that the register 11B corresponds to an even-numbered grid timing. In the octuplex anode matrix scheme, as shown in FIG. 8(*b*), the shift register 11 is divided every four stages such that the shift register 11A corresponds to an odd-numbered grid timing and that the register 11B corresponds to an even-numbered grid timing. In the octuplex anode matrix scheme shown in FIG. 8(*b*), because there is not a clear design rule in the anode connection order, all the anode segments in column direction are labeled with the letter x.

In the case of the simple anode matrix scheme, it is unnecessary to divide the shift register in accordance with the odd-numbered timing and the even-numbered timing. For that reason, the shift register 11 is configured as one system configuration, as shown in FIG. 7(*a*). In a manner similar to the driver output connection changing operation, the shift register changeover control circuit 21 controls all the switches 26 synchronously and changeably to built up the connection configuration of the shift register 11 (11A, 11B) in various drive schemes.

FIG. 9 is illustrates the circuit configuration for changing the connection configuration of the shift register 11. Referring to FIG. 9, the serial input SI, to which the same anode data is input in accordance with the drive scheme, is divided into the serial input SIa for the odd-numbered grid timing and the serial input SIb for the even-numbered grid timing. The changeover switches 26 (SW1, SW2, Sw3, . . . ) are disposed across the registers R1, R2, . . . of the shift register 11, respectively. In the circuit configuration shown in FIG. 9, any one of the simple anode matrix scheme M1, the duplex anode matrix scheme M2, the quadplex anode matrix scheme M4, and the octuplex anode matrix scheme M8 can be selected by the switching operation. The serial clock CLK and the latch LAT are supplied in common to all the registers R1, R2, . . . of the shift register 11.

FIG. 10 is a table listing connections between the registers R1 to Rn of the shift register 11, the odd-numbered serial input SIa, and the even-numbered serial input SIb. FIG. 11 is a table listing connections applicable for the serial input SIa only. In FIGS. 10 and FIG. 11, symbol (○) represents a connection state while symbol (X) represents in a non-connection state.

In the configuration of FIG. 9, in order to select the simple anode matrix scheme, the changeover switches 26 (SW1, SW2, SW3, . . . ) are turned to the M1 side. Thus, all the registers R1, R2, R3, . . . are serially connected via the changeover switches 26. This operation makes the shift register 11 having one stage configuration, as shown in FIG. 7(*a*).

In order to select the dulex anode matrix scheme, the changeover switches 26 (SW1, SW2, SW3, . . . ) are turned to the M2 side. Odd-numbered registers R1, R3, R5, . . . are serially connected via the odd-numbered changeover switches 26 (SW1, Sw3, SW5, . . . ). Even-numbered registers R2, R4, R6, . . . are serially connected via the even-numbered changeover switches 26 (SW2, Sw4, SW6, . . . ). Thus, the shift register 11 is divided into two systems: a first register chain corresponding to odd-numbered grid timings and a second register chain corresponding to even-numbered grid timings, as shown in FIG. 7(*b*). That is, registers are divided alternately from the register R1.

In order to select the quadplex anode matrix scheme, the changeover switches 26 (SW1, SW2, SW3, . . . ) are turned to the M4 side. Registers R1, R2, R5, R6, . . . are serially connected via the switches 26 (SW1, SW2, SW5, SW6, . . . ). Registers R3, R4, R7, R8, . . . are serially connected via the changeover switches 26 (SW3, SW4, SW7, SW8, . . . ). Thus, the shift register 11 is divided into two systems, namely, a first register chain corresponding to odd-numbered grid timings and a second register chain corresponding to even-numbered grid timings, as shown in FIG. 8(*a*). That is, registers are divided every two registers from the register R1.

In order to select the octuplex anode matrix scheme, the changeover switches 26 (SW1, SW2, SW3, . . . ) are turned to the M8 side. Registers R1, R2, R3, R4, . . . are serially connected via the switches 26 (SW1, SW2, SW3, SW4, . . . ). Registers R5, R6, R7, R8, . . . are serially connected via the changeover switches 26 (SW5, SW6, SW7, SW8, . . . ). The shift register 11 is divided into two systems, namely a first register chain corresponding to odd-numbered grid timings and a second register chain corresponding to even-numbered grid timings, as shown in FIG. 8(*b*). That is, registers are divided every four registers from the register R1.

As understood from FIG. 11, the multiplex anode matrix scheme (e.g. the duplex, quadplex, or octuplex anode matrix scheme), in which the shift register 11 is in a dual configuration, except for the simple anode matrix scheme, has the regularity represented as three bits in a simple binary code. That is, in the case of multiple anode matrix schemes, the shift register 11 has register chains in two systems, each having $2^{n-1}$ stages (where n is 1, 2, 3, . . . ). This suggests that the changeover switches 26 can be controllably changed programmably, using, for example, decoders.

In the multiplex anode driver circuit 4 of the present embodiment, in order to change the circuit configuration of the shift register 11 in accordance with the driving schemes, blanking is allocated for the odd-numbered grid timing and the even-numbered grid timing. By doing so, the connection configuration is controllably changed in accordance with the drive schemes. FIG. 12 illustrates connections between respective blanking terminals and the driver stages in accordance with the anode matrix schemes. Connections to the blankings BK1 and BK2 are listed on the table in FIG. 13. FIG. 14 shows the mode applicable for only the blanking BK1. In FIGS. 13 and 14, symbol (○) represents a connection state while symbol (X) represents a non-connection state.

Referring to FIG. 12, it is noted that the code for connection matches with the switching configuration, which changes the circuit configuration of the shift register 11 shown in FIG. 9. The blanking changeover control circuit 22 can controllably switch the blankings BK1 and BK2, which are input to the latch circuit 12 (L1, L2, L3, . . . ), with the same connection code for the changeover switch 27 as the changeover switch 26 that switches the circuit configuration of the shift register 11. The difference is that the number of the changeover switches 27 can be halved.

The drive scheme selection control circuit 24 comprehensively controls the shift register changeover control circuit 21 for controllably changing the connection configuration of the shift register 11, the blanking changeover control circuit 22 for controllably changing the blanking connection configuration, and the driver output changeover control circuit 23 for controlling the driver outputs. The drive scheme selection control circuit 24 has the control signal input terminal (Cont) to which data representing a drive scheme (the simple, duplex, quadplex, or octuplex anode matrix scheme) is set. A command can be transferred or set as serial data representing a drive scheme to the Cont terminal or the code setting can be directly made to the Cont terminal, using hardware. Various, general type of data may be input to the Cont terminal but are not essential to the feature and advantage of the present invention. Hence, the further explanation will be omitted here.

When receiving data representing a drive scheme from the terminal Cont, the drive scheme control circuit 24 comprehensively controls the shift register changeover control circuit 21, the blanking changeover control circuit 22, and the driver output changeover control circuit 23. By doing so, the connection configuration of the shift register 11 matching with the anode wiring in the corresponding drive scheme and the connection configuration between the drive outputs of the output circuit 13 and the blanking BK input to the latch circuit 12 are made.

In the multiplex anode driver circuit 4, the data transfer operation to the portions (X) having no corresponding segments is reduced on the drive matrix. For that reason, the driver circuit has a dual configuration including the register chains 11A and 11B of the shift registers 11, separated into two systems. The shift register 11A is allocated for the odd-numbered grid timing while the shift register 11B is allocated for the even-numbered grid timing. Thus, compared with the conventional anode driver circuit, the anode driver circuit 4 can perform its drive operation, with a display RAM of a halved memory capacity, in which display data is previously stored. Moreover, anode data transfer bits per grid timing can be halved in number, compared with the conventional anode driver circuit. This feature can improve the transfer rate to a half value. The hardware can be shrunken.

Conventionally, rearranging the driver outputs in accordance with the order of the anode wiring conductors of a fluorescent display device results in the dedicated driver with poor versatility. However, in the multiplex anode driver circuit 4 of the present embodiment, the logic switches (25, 26, 27) rearrange the driver outputs in accordance with the order of anode wiring conductors in a selected drive scheme. This feature allows the driver outputs matching the order of the anode wiring conductors in the simple or multiplex (e.g. dual, quadplex or octuplex) anode matrix scheme to be obtained. Thus, the driver employing the simple or multiplex matrix scheme can be shared. Moreover, the sharing can be realized by merely connecting the driver outputs in the order of anode wiring conductors. Special data transformation is not required. Data can be directly transferred to anodes. This enables improving the usability.

The COG fluorescent display device has been explained in the embodiments of the present invention. However, the driver circuit according to the present invention is applicable to CIG fluorescent display devices, which incorporate the driver circuit, and to general fluorescent display devices.

According to the present invention, the anode driver circuit has as many registers as the conventional anode driver circuit has. However, the number of registers per shift register can be halved. With the grid timing being constant, the number of transfer bits per grid timing can be halved. As a result, the bit transfer rate can be halved, compared with that in the conventional anode driver circuit. Moreover, general-purpose components can be used so that the range of choice can be widened.

Moreover, since anode data to be previously stored is halved in volume, the memory capacity for display data can be reduced. This allows a small capacity RAM to be used, even if the RAM capacity is restricted because of cost problems. Moreover, when the display data memory capacity is equalized to that in the conventional anode driver circuit, the reduced memory capacity can be used for gray level display or for data areas for other applications.

Moreover, the present invention allows the driver in the simple matrix scheme and the driver in the multiplex matrix scheme to be shared with each other. Thus, the transfer rate can be improved and the hardware can be slimmed.

What is claimed is:

1. A multiplex anode driver circuit for a fluorescent display device comprising:

shift registers formed of a first shift register being allocated to an even-numbered grid timing and to an odd numbered grid timing when a plurality of grids are scanned and second shift register being allocated to odd numbered grid timing when said plurality of grids are scanned;

a first group of latch circuits respectively connected to a plurality of first sub-registers in said first shift register, each latch circuit holding anode data of a corresponding first sub-register, and a second group of latch circuits respectively connected to a plurality of second sub-registers in said second shift register, each latch circuit holding anode data of a corresponding second sub-register; and a memory for storing anode data to be input to said shift registers;

wherein while blanking an input to said first group of latch circuits associated said first shift register and blanking an input to said second group of latch circuits associated said second shift register are being alternately released, the odd-numbered grid timing and the even-numbered grid timing are selected for permitting anode data to transfer from said memory.

2. The multiplex anode driver circuit as defined in claim 1, wherein when a drive scheme is selectively set from among a simple anode matrix scheme, a duplex anode matrix scheme, and quadplex anode matrix scheme, and an octuplex anode matrix scheme, said first and second shift registers are selectively connected in conjunction with a selected drive scheme to obtain drive outputs corresponding to an anode wiring state to transfer anode data.

3. A fluorescent display device comprising:

dot-like anodes arranged in a matrix form and having surfaces coated with a fluorescent substance;

a plurality of grids confronting said anodes;

a plurality of cathodes confronting said plurality of grids; and a multiplex anode driver circuit;

said multiple anode driver circuit including:

(a) shift registers formed of a first shift register being allocated to an even-numbered grid timing and to an odd numbered grid timing when said plurality of grids are scanned and second shift register being allocated to odd numbered grid timing when said plurality of grids are scanned;

(b) a first group of latch circuits circuits respectively connected to a plurality of first sub-registers in said first shift register, each latch circuit holding anode data of a corresponding register, and a second group of latch circuits respectively connected to registers in said second shift register, each latch circuit holding anode data of a corresponding second sub-register; and (c) a memory for storing anode data to be input to said shift registers;

(d) wherein while blanking an input to said first group of latch circuits associated said first shift register and blanking an input to said second group of latch circuits associated said second shift register are being alternately released, the odd-numbered grid timing and the even-numbers grid timing are selected for permitting anode data to transfer from said memory.

4. The fluorescent display device as defined in claim 3, wherein when a drive scheme is selectively set from among a simple anode matrix scheme, a duplex anode matrix scheme, a quadplex anode matrix scheme and an octuplex anode matrix scheme, said multiplex anode driver circuit selectively connects said first and second shift registers, in conjunction with a selected drive scheme, to obtain drive outputs corresponding to an anode wiring state to transfer anode data.

* * * * *

UNITED STATES PATENT AND TRADEMARK OFFICE

CERTIFICATE OF CORRECTION

PATENT NO. : 6,703,789 B2
DATED : March 9, 2004
INVENTOR(S) : Hiraga

It is certified that error appears in the above-identified patent and that said Letters Patent is hereby corrected as shown below:

Title page, Item [54] and Column 1 lines 1-2,
Title, should read: -- [54] MULTIPLEX ANODE DRIVER CIRCUIT AND FLUORESCENT DISPLAY DEVICE --
Item [73], Assignee, should read:
-- [73] Assignee: Futaba Corporation, Mobara (JP) --

Signed and Sealed this

Eighteenth Day of May, 2004

JON W. DUDAS
*Acting Director of the United States Patent and Trademark Office*